US007466298B2

(12) United States Patent
Sawabe

(10) Patent No.: US 7,466,298 B2
(45) Date of Patent: Dec. 16, 2008

(54) LIQUID CRYSTAL DISPLAY DEVICE FOR IMPROVING A DISPLAY RESPONSE SPEED AND DRIVING METHOD FOR THE SAME

(75) Inventor: Daiichi Sawabe, Tsu (JP)

(73) Assignee: Sharp Kabushiki Kaisha, Osaka (JP)

( * ) Notice: Subject to any disclaimer, the term of this patent is extended or adjusted under 35 U.S.C. 154(b) by 771 days.

(21) Appl. No.: 10/924,986

(22) Filed: Aug. 25, 2004

(65) Prior Publication Data

US 2005/0052389 A1 Mar. 10, 2005

(30) Foreign Application Priority Data

Sep. 9, 2003 (JP) ..... 2003-317182
Jul. 6, 2004 (JP) ..... 2004-199867

(51) Int. Cl.
*G09G 3/36* (2006.01)

(52) U.S. Cl. ..... 345/89; 345/690

(58) Field of Classification Search ..... 345/690, 345/87, 88, 89; 349/108, 144
See application file for complete search history.

(56) References Cited

U.S. PATENT DOCUMENTS 5,606,437 A * 2/1997 Mosier ..... 349/144
6,335,778 B1 1/2002 Kubota et al.
6,801,220 B2 * 10/2004 Greier et al. ..... 345/690
6,972,779 B2 * 12/2005 Motai et al. ..... 345/690
7,071,911 B2 * 7/2006 Inukai ..... 345/92
7,142,186 B2 * 11/2006 Lee et al. ..... 345/89
7,145,534 B2 * 12/2006 Ham ..... 345/87
7,268,757 B2 * 9/2007 Ben-David et al. ..... 345/89
7,283,192 B2 * 10/2007 Shimoshikiryo ..... 349/144
2003/0039407 A1 * 2/2003 Okada ..... 382/298
2003/0146893 A1 8/2003 Sawabe
2005/0036704 A1 * 2/2005 Dumitras et al. ..... 382/260

FOREIGN PATENT DOCUMENTS

JP 63-25556 B2 5/1988
JP 06-138844 A 5/1994
JP 11-109358 4/1999
JP 2002-116737 4/2002

* cited by examiner

*Primary Examiner*—Chanh Nguyen
*Assistant Examiner*—Allison Walthall
(74) *Attorney, Agent, or Firm*—Harness, Dickey & Pierce P.L.C.

(57) ABSTRACT

A liquid crystal display device includes liquid crystal elements, each of which is provided on one of a plurality of divisional display areas so as to display the divisional display area; and display driving section for displaying the liquid crystal elements with a weighted mean of luminance ratios of the liquid crystal elements, so as to reduce a display response time of the display area to be shorter than a hypothetical display response time that is obtained when the display area is displayed with a single liquid crystal element. In this way, a liquid crystal display device that improves a response time, and the driving method thereof are provided.

18 Claims, 19 Drawing Sheets

FIG. 3

| | | LUMINANCE AT THE END (LUMINANCE RATIO) | | | | | | | | | | | | | | | | | | | | |
|---|---|---|---|---|---|---|---|---|---|---|---|---|---|---|---|---|---|---|---|---|---|---|
| | | 0.00 | 0.05 | 0.10 | 0.15 | 0.20 | 0.25 | 0.30 | 0.35 | 0.40 | 0.45 | 0.50 | 0.55 | 0.60 | 0.65 | 0.70 | 0.75 | 0.80 | 0.85 | 0.90 | 0.95 | 1.00 |
| LUMINANCE AT THE BEGINNING (LUMINANCE RATIO) | 0.00 | 0 | 100.5 | 83.6 | 73.1 | 62.5 | 55.5 | 48.5 | 41.5 | 37.8 | 34.1 | 30.4 | 28.6 | 26.7 | 24.9 | 23 | 21.2 | 19.8 | 18.4 | 16.9 | 15.5 | 14.1 |
| | 0.05 | 16.5 | 0 | 37.3 | 40.6 | 43.9 | 39.7 | 35.6 | 31.4 | 29.1 | 26.9 | 24.6 | 23.6 | 22.6 | 21.6 | 20.6 | 19.6 | 18.8 | 18.1 | 17.3 | 16.6 | 15.8 |
| | 0.10 | 15.7 | 21.4 | 0 | 32.6 | 27.4 | 29 | 30.7 | 32.3 | 29.5 | 26.8 | 24 | 23.1 | 22.3 | 21.4 | 20.6 | 19.7 | 19 | 18.2 | 17.5 | 16.7 | 16 |
| | 0.15 | 15.2 | 28.6 | 28.5 | 0 | 28.9 | 28.9 | 29.3 | 29.6 | 27.4 | 25.3 | 23.1 | 22.3 | 21.6 | 20.8 | 20.1 | 19.3 | 18.7 | 18 | 17.4 | 16.8 | 16.2 |
| | 0.20 | 14.7 | 35.8 | 25.9 | 28.4 | 0 | 28.6 | 28.1 | 26.9 | 25.3 | 23.8 | 22.2 | 21.5 | 20.9 | 20.2 | 19.6 | 18.9 | 18.4 | 17.9 | 17.3 | 16.8 | 16.3 |
| | 0.25 | 14.6 | 36 | 28.8 | 29.2 | 29 | 0 | 27.3 | 26 | 24.4 | 22.6 | 20.6 | 20.4 | 20.2 | 20 | 19.8 | 19.6 | 19 | 18.3 | 17.6 | 17 | 16.3 |
| | 0.30 | 14.4 | 36.3 | 31.8 | 30.9 | 29.8 | 28.4 | 0 | 25.4 | 23.6 | 21.5 | 19.1 | 19.3 | 19.6 | 19.9 | 20.1 | 20.4 | 19.6 | 18.8 | 18 | 17.2 | 16.4 |
| | 0.35 | 14.3 | 36.5 | 34.7 | 32.8 | 30.9 | 28.5 | 26.7 | 0 | 23.1 | 21.1 | 17.5 | 18.2 | 18.9 | 19.7 | 20.4 | 21.1 | 20.2 | 19.2 | 18.3 | 17.3 | 16.4 |
| | 0.40 | 14.3 | 35.5 | 33.8 | 32.2 | 30.6 | 28.4 | 26.3 | 24.5 | 0 | 21.2 | 19.9 | 19.3 | 19.5 | 19.7 | 20 | 20.3 | 19.5 | 18.7 | 18 | 17.2 | 16.4 |
| | 0.45 | 14.2 | 34.4 | 32.8 | 31.6 | 30.3 | 28 | 25.8 | 24 | 22.6 | 0 | 20.7 | 20.1 | 19.9 | 19.8 | 19.7 | 19.5 | 18.9 | 18.3 | 17.6 | 17 | 16.4 |
| | 0.50 | 14.2 | 33.4 | 31.9 | 31 | 30 | 27.5 | 24.9 | 22.4 | 22.4 | 21.8 | 0 | 20.6 | 20.1 | 19.8 | 19.4 | 18.7 | 18.2 | 17.8 | 17.3 | 16.9 | 16.4 |
| | 0.55 | 14.2 | 32.7 | 30.8 | 30 | 29.2 | 27.1 | 24.9 | 22.8 | 22.4 | 21.9 | 21.4 | 0 | 20.3 | 19.9 | 19.4 | 18.9 | 18.4 | 17.9 | 17.5 | 17 | 16.5 |
| | 0.60 | 14.3 | 32.1 | 29.6 | 29 | 28.4 | 26.7 | 25 | 23.2 | 22.7 | 22.1 | 21.6 | 21 | 0 | 20 | 19.5 | 19 | 18.5 | 18 | 17.6 | 17.1 | 16.7 |
| | 0.65 | 14.3 | 31.4 | 28.5 | 28 | 27.6 | 26.3 | 25 | 23.7 | 23 | 22.4 | 21.8 | 21.1 | 20.6 | 0 | 19.5 | 19.1 | 18.6 | 18.2 | 17.7 | 17.3 | 16.8 |
| | 0.70 | 14.4 | 30.8 | 27.3 | 27.1 | 26.8 | 25.9 | 25 | 24.1 | 23.4 | 22.6 | 21.9 | 21.2 | 20.6 | 20.1 | 0 | 19.1 | 18.7 | 18.3 | 17.8 | 17.4 | 17 |
| | 0.75 | 14.4 | 30.1 | 26.2 | 26.1 | 26 | 25.5 | 25 | 24.5 | 23.7 | 22.9 | 22.1 | 21.2 | 20.6 | 20.1 | 19.6 | 0 | 18.8 | 18.4 | 18 | 17.5 | 17.1 |
| | 0.80 | 14.4 | 29.6 | 26.3 | 26.1 | 25.9 | 25.3 | 24.6 | 24 | 23.2 | 22.4 | 21.5 | 21 | 20.5 | 20 | 19.6 | 19.3 | 0 | 18.5 | 18.1 | 17.6 | 17.2 |
| | 0.85 | 14.5 | 29 | 26.3 | 26.1 | 25.8 | 25 | 24.3 | 23.5 | 22.7 | 21.8 | 21 | 20.6 | 20.3 | 19.9 | 19.6 | 19.3 | 19 | 0 | 18.2 | 17.8 | 17.3 |
| | 0.90 | 14.5 | 28.5 | 26.4 | 26 | 25.7 | 24.8 | 23.9 | 23.1 | 22.2 | 21.3 | 20.4 | 20.2 | 20 | 19.8 | 19.7 | 19.4 | 19.2 | 18.8 | 0 | 18 | 17.4 |
| | 0.95 | 14.6 | 27.9 | 26.4 | 26 | 25.6 | 24.6 | 23.6 | 22.6 | 21.7 | 20.8 | 19.9 | 19.8 | 19.8 | 19.8 | 19.7 | 19.6 | 19.4 | 19.1 | 18.7 | 0 | 17.5 |
| | 1.00 | 14.6 | 27.4 | 26.5 | 26 | 25.5 | 24.4 | 23.2 | 22.1 | 21.2 | 20.2 | 19.3 | 19.4 | 19.5 | 19.7 | 19.8 | 19.9 | 19.6 | 19.4 | 19.1 | 18.8 | 0 |

FIG. 5

T1

| | | | LUMINANCE AT THE END (LUMINANCE RATIO) | | | | | | | | | | |
|---|---|---|---|---|---|---|---|---|---|---|---|---|---|
| LUMINANCE AT THE BEGINNING (LUMINANCE RATIO) | DIVISIONAL SUB-PIXEL | | 0 | 0.1 | 0.2 | 0.3 | 0.4 | 0.5 | 0.6 | 0.7 | 0.8 | 0.9 | 1 |
| | A | 0 | 0 | 0.017 | 0.017 | 0.016 | 0 | 0 | 0.584 | 0.69 | 0.8 | 0.9 | 1 |
| | B | 0 | 0 | 0.183 | 0.383 | 0.584 | 0.8 | 1 | 0.616 | 0.71 | 0.8 | 0.9 | 1 |
| | A | 0 | 0 | 0.016 | 0 | 0 | 0 | 1 | 0.67 | 0.744 | 0.815 | 0.89 | 1 |
| | B | 0.1 | 0 | 0.184 | 0.4 | 0.6 | 0.8 | 0 | 0.53 | 0.656 | 0.785 | 0.91 | 1 |
| | A | 0 | 0 | 0 | 0 | 0.01 | 0 | 1 | 1 | 0.766 | 0.827 | 0.892 | 1 |
| | B | 0.2 | 0 | 0.2 | 0.4 | 0.59 | 0.8 | 0 | 0.2 | 0.634 | 0.773 | 0.908 | 1 |
| | A | 0 | 0 | 0 | 0.013 | 0.012 | 0 | 1 | 0.92 | 0.879 | 0.99 | 0.875 | 1 |
| | B | 0.3 | 0 | 0.2 | 0.387 | 0.588 | 0.8 | 0 | 0.28 | 0.521 | 0.61 | 0.925 | 1 |
| | A | 0 | 0 | 0 | 0 | 0 | 0 | 1 | 0.834 | 1 | 1 | 0.88 | 1 |
| | B | 0.4 | 0 | 0.2 | 0.4 | 0.6 | 0.8 | 0 | 0.366 | 0.4 | 0.6 | 0.92 | 1 |
| | A | 0 | 0 | 0 | 0 | 0.011 | 0 | 1 | 0.747 | 0.932 | 0.84 | 0.892 | 1 |
| | B | 0.5 | 0 | 0.2 | 0.4 | 0.589 | 0.8 | 0 | 0.453 | 0.468 | 0.76 | 0.908 | 1 |
| | A | 0 | 0 | 0.01 | 0 | 0 | 0 | 1 | 0.715 | 0.843 | 1 | 0.884 | 1 |
| | B | 0.6 | 0 | 0.19 | 0.4 | 0.6 | 0.8 | 0 | 0.485 | 0.557 | 0.6 | 0.916 | 1 |
| | A | 0 | 0 | 0.017 | 0 | 0 | 0.01 | 1 | 0.71 | 0.767 | 0.937 | 0.876 | 1 |
| | B | 0.7 | 0 | 0.183 | 0.4 | 0.6 | 0.79 | 0 | 0.49 | 0.633 | 0.663 | 0.924 | 1 |
| | A | 0 | 0 | 0 | 0 | 0 | 0 | 1 | 0.718 | 0.772 | 0.847 | 1 | 1 |
| | B | 0.8 | 0 | 0.2 | 0.4 | 0.6 | 0.8 | 0 | 0.482 | 0.628 | 0.753 | 0.8 | 1 |
| | A | 0 | 0 | 0 | 0 | 0.01 | 0 | 1 | 0.747 | 0.787 | 0.81 | 0.94 | 1 |
| | B | 0.9 | 0 | 0.2 | 0.4 | 0.59 | 0.8 | 0 | 0.453 | 0.613 | 0.79 | 0.86 | 1 |
| | A | 0 | 0 | 0 | 0 | 0 | 0 | 0 | 0.76 | 0.9 | 1 | 0.891 | 1 |
| | B | 1 | 0 | 0.2 | 0.4 | 0.6 | 0.8 | 1 | 0.44 | 0.5 | 0.6 | 0.909 | 1 |
| | A | 0.1 | 0 | 0.184 | 0.399 | 0.599 | 0.799 | 0 | 0.53 | 0.656 | 0.785 | 0.91 | 1 |
| | B | 0 | 0 | 0.016 | 0.001 | 0.001 | 0.001 | 1 | 0.67 | 0.744 | 0.815 | 0.89 | 1 |
| | A | 0.1 | 0 | 0.1 | 0.2 | 0 | 0 | 0 | 0.6 | 0.7 | 0.8 | 0.9 | 1 |
| | B | 0.1 | 0 | 0.1 | 0.2 | 0.6 | 0.8 | 1 | 0.6 | 0.7 | 0.8 | 0.9 | 1 |
| | A | 0.1 | 0 | 0 | 0.127 | 0.01 | 0 | 1 | 1 | 0.73 | 0.812 | 0.904 | 1 |
| | B | 0.2 | 0 | 0.2 | 0.273 | 0.59 | 0.8 | 0 | 0.2 | 0.67 | 0.788 | 0.896 | 1 |
| | A | 0.1 | 0 | 0.179 | 0.1 | 0.079 | 0.799 | 1 | 0.922 | 0.879 | 0.77 | 0.881 | 1 |
| | B | 0.3 | 0 | 0.021 | 0.3 | 0.521 | 0.001 | 0 | 0.278 | 0.521 | 0.83 | 0.919 | 1 |
| | A | 0.1 | 0 | 0.179 | 0 | 0.126 | 0.799 | 1 | 0.833 | 1 | 0.787 | 0.887 | 1 |
| | B | 0.4 | 0 | 0.021 | 0.4 | 0.474 | 0.001 | 0 | 0.367 | 0.4 | 0.813 | 0.913 | 1 |
| | A | 0.1 | 0 | 0.179 | 0 | 0.1 | 0 | 1 | 0.744 | 0.934 | 0.826 | 0.905 | 1 |
| | B | 0.5 | 0 | 0.021 | 0.4 | 0.5 | 0.8 | 0 | 0.456 | 0.466 | 0.774 | 0.895 | 1 |
| | A | 0.1 | 0 | 0.179 | 0 | 0 | 0.127 | 1 | 0.657 | 0.842 | 1 | 0.897 | 1 |
| | B | 0.6 | 0 | 0.021 | 0.4 | 0.6 | 0.673 | 0 | 0.543 | 0.558 | 0.6 | 0.903 | 1 |
| | A | 0.1 | 0 | 0.179 | 0 | 0 | 0.1 | 1 | 0.653 | 0.749 | 0.94 | 0.885 | 1 |
| | B | 0.7 | 0 | 0.021 | 0.4 | 0.6 | 0.7 | 0 | 0.547 | 0.651 | 0.66 | 0.915 | 1 |
| | A | 0.1 | 0 | 0.179 | 0 | 0 | 0 | 0.125 | 0.662 | 0.737 | 0.847 | 1 | 1 |
| | B | 0.8 | 0 | 0.021 | 0.4 | 0.6 | 0.8 | 0.875 | 0.538 | 0.663 | 0.753 | 0.8 | 1 |
| | A | 0.1 | 0 | 0.179 | 0 | 0.01 | 0.799 | 0.1 | 0.704 | 0.744 | 0.786 | 0.943 | 1 |
| | B | 0.9 | 0 | 0.021 | 0.4 | 0.59 | [illegible] | [illegible] | [illegible] | [illegible] | [illegible] | [illegible] | [illegible] |
| | [illegible] | [illegible] | [illegible] | [illegible] | [illegible] | 0.59 | 0.007 | 0.996 | 0.534 | 0.748 | 0.9 | 0.855 | 1 |
| | B | 0.7 | 0 | 0.001 | 0.001 | 0.01 | 0.793 | 0.004 | 0.666 | 0.652 | 0.7 | 0.945 | 1 |
| | A | 0.9 | 0 | 0.199 | 0.399 | 0.59 | 0 | 0.995 | 0.559 | 0.706 | 0.848 | 0.973 | 1 |
| | B | 0.8 | 0 | 0.001 | 0.001 | 0.01 | 0.8 | 0.005 | 0.641 | 0.694 | 0.752 | 0.827 | 1 |
| | A | 0.9 | 0 | 0 | 0 | 0.01 | 0 | 0.005 | 0.59 | 0.7 | 0.8 | 0.9 | 1 |
| | B | 0.9 | 0 | 0.2 | 0.4 | 0.59 | 0.8 | 0.995 | 0.61 | 0.7 | 0.8 | 0.9 | 1 |
| | A | 0.9 | 0 | 0 | 0 | 0 | 0.799 | 0 | 0.709 | 0.9 | 0.759 | 0.871 | 1 |
| | B | 1 | 0 | 0.2 | 0.4 | 0.6 | 0.001 | 1 | 0.491 | 0.5 | 0.841 | 0.929 | 1 |
| | A | 1 | 0 | 0.199 | 0.399 | 0.599 | 0.799 | 1 | 0.44 | 0.5 | 0.6 | 0.909 | 1 |
| | B | 0 | 0 | 0.001 | 0.001 | 0.001 | 0.001 | 0 | 0.76 | 0.9 | 1 | 0.891 | 1 |
| | A | 1 | 0 | 0.021 | 0.399 | 0.5 | 0 | 1 | 0.472 | 0.5 | 0.837 | 0.907 | 1 |
| | B | 0.1 | 0 | 0.179 | 0.001 | 0.1 | 0.8 | 0 | 0.728 | 0.9 | 0.763 | 0.893 | 1 |
| | A | 1 | 0 | 0 | 0.399 | 0.599 | 0 | 1 | 1 | 0.5 | 0.862 | 0.908 | 1 |
| | B | 0.2 | 0 | 0.2 | 0.001 | 0.001 | 0.8 | 0 | 0.2 | 0.9 | 0.738 | 0.892 | 1 |
| | A | 1 | 0 | 0.199 | 0.022 | 0.015 | 0.5 | 1 | 0.92 | 0.895 | 0.6 | 0.904 | 1 |
| | B | 0.3 | 0 | 0.001 | 0.378 | 0.585 | 0.3 | 0 | 0.28 | 0.505 | 1 | 0.896 | 1 |
| | A | 1 | 0 | 0.199 | 0 | 0 | 0 | 1 | 0.836 | 1 | 0.6 | 0.905 | 1 |
| | B | 0.4 | 0 | 0.001 | 0.4 | 0.6 | 0.8 | 0 | 0.364 | 0.4 | 1 | 0.895 | 1 |
| | A | 1 | 0 | 0.199 | 0.399 | 0.011 | 0 | 1 | 0.499 | 0.929 | 0.879 | 0.908 | 1 |
| | B | 0.5 | 0 | 0.001 | 0.001 | 0.589 | 0.8 | 0 | 0.701 | 0.471 | 0.721 | 0.892 | 1 |
| | A | 1 | 0 | 0.199 | 0.399 | 0 | 0 | 1 | 0.501 | 0.5 | 1 | 0.907 | 1 |
| | B | 0.6 | 0 | 0.001 | 0.001 | 0.6 | 0.8 | 0 | 0.699 | 0.9 | 0.6 | 0.893 | 1 |
| | A | 1 | 0 | 0.199 | 0.399 | 0.599 | 0.007 | 1 | 0.5 | 0.5 | 0.929 | 0.906 | 1 |
| | B | 0.7 | 0 | 0.001 | 0.001 | 0.001 | 0.793 | 0 | 0.7 | 0.9 | 0.671 | 0.894 | 1 |
| | A | 1 | 0 | 0.199 | 0.399 | 0.599 | 0 | 1 | 0.494 | 0.5 | 0.854 | 1 | 1 |
| | B | 0.8 | 0 | 0.001 | 0.001 | 0.001 | 0.8 | 0 | 0.706 | 0.9 | 0.746 | 0.8 | 1 |
| | A | 1 | 0 | 0.199 | 0.399 | 0.599 | 0 | 1 | 0.491 | 0.5 | 0.841 | 0.929 | 1 |
| | B | 0.9 | 0 | 0.001 | 0.001 | 0.001 | 0.8 | 0 | 0.709 | 0.9 | 0.759 | 0.871 | 1 |
| | A | 1 | 0 | 0 | 0 | 0 | 0 | 0 | 0.6 | 0.5 | 0.6 | 0.895 | 1 |
| | B | 1 | 0 | 0.2 | 0.4 | 0.6 | 0.8 | 1 | 0.6 | 0.9 | 1 | 0.905 | 1 |

FIG. 6

| | | LUMINANCE AT THE END (LUMINANCE RATIO) | | | | | | | | | | | | | | | | | | | | |
|---|---|---|---|---|---|---|---|---|---|---|---|---|---|---|---|---|---|---|---|---|---|---|
| | | 0.00 | 0.05 | 0.10 | 0.15 | 0.20 | 0.25 | 0.30 | 0.35 | 0.40 | 0.45 | 0.50 | 0.55 | 0.60 | 0.65 | 0.70 | 0.75 | 0.80 | 0.85 | 0.90 | 0.95 | 1.00 |
| LUMINANCE AT THE BEGINNING (LUMINANCE RATIO) | 0.00 | 0 | 34.4 | 30.2 | 27.6 | 24.9 | 23.2 | 21.4 | 19.7 | 18.7 | 17.8 | 16.9 | 16.4 | 16 | 15.5 | 15 | 14.6 | 14.2 | 13.9 | 13.5 | 13.2 | 12.8 |
| | 0.05 | 13.4 | 0 | 18.6 | 19.4 | 20.3 | 19.2 | 18.2 | 17.1 | 16.6 | 16 | 15.4 | 15.2 | 14.9 | 14.7 | 14.4 | 14.2 | 14 | 13.8 | 13.6 | 13.4 | 13.2 |
| | 0.10 | 13.2 | 14.6 | 0 | 17.4 | 16.1 | 16.5 | 17 | 17.4 | 16.7 | 16 | 15.3 | 15.1 | 14.9 | 14.6 | 14.4 | 14.2 | 14 | 13.8 | 13.7 | 13.5 | 13.3 |
| | 0.15 | 13.1 | 16.4 | 16.4 | 0 | 16.5 | 16.5 | 16.6 | 16.7 | 16.1 | 15.6 | 15.1 | 14.9 | 14.7 | 14.5 | 14.3 | 14.1 | 13.9 | 13.8 | 13.6 | 13.5 | 13.3 |
| | 0.20 | 13 | 18.2 | 15.8 | 16.4 | 0 | 16.4 | 16.3 | 16 | 15.6 | 15.2 | 14.8 | 14.7 | 14.5 | 14.3 | 14.2 | 14 | 13.9 | 13.8 | 13.6 | 13.5 | 13.4 |
| | 0.25 | 12.9 | 18.3 | 16.5 | 16.6 | 16.5 | 0 | 16.1 | 15.8 | 15.4 | 14.9 | 14.4 | 14.4 | 14.3 | 14.3 | 14.2 | 14.2 | 14 | 13.9 | 13.7 | 13.5 | 13.4 |
| | 0.30 | 12.9 | 18.4 | 17.2 | 17 | 16.7 | 16.4 | 0 | 15.6 | 15.2 | 14.7 | 14.1 | 14.1 | 14.2 | 14.2 | 14.3 | 14.4 | 14.2 | 14 | 13.8 | 13.6 | 13.4 |
| | 0.35 | 12.9 | 18.4 | 18 | 17.5 | 17 | 16.4 | 15.9 | 0 | 15.1 | 14.5 | 13.7 | 13.8 | 14 | 14.2 | 14.4 | 14.6 | 14.3 | 14.1 | 13.9 | 13.6 | 13.4 |
| | 0.40 | 12.9 | 18.2 | 17.7 | 17.3 | 16.9 | 16.4 | 15.9 | 15.4 | 0 | 14.6 | 14.3 | 14.1 | 14.1 | 14.2 | 14.3 | 14.4 | 14.2 | 14 | 13.8 | 13.6 | 13.4 |
| | 0.45 | 12.8 | 17.9 | 17.5 | 17.2 | 16.9 | 16.3 | 15.7 | 15.3 | 14.9 | 0 | 14.4 | 14.3 | 14.2 | 14.2 | 14.2 | 14.2 | 14 | 13.8 | 13.7 | 13.5 | 13.4 |
| | 0.50 | 12.8 | 17.6 | 17.3 | 17 | 16.8 | 16.2 | 15.5 | 14.9 | 14.9 | 14.7 | 0 | 14.4 | 14.3 | 14.2 | 14.1 | 14 | 13.8 | 13.7 | 13.6 | 13.5 | 13.4 |
| | 0.55 | 12.8 | 17.5 | 17 | 16.8 | 16.6 | 16 | 15.5 | 15 | 14.9 | 14.8 | 14.6 | 0 | 14.4 | 14.2 | 14.1 | 14 | 13.9 | 13.8 | 13.6 | 13.5 | 13.4 |
| | 0.60 | 12.9 | 17.3 | 16.7 | 16.5 | 16.4 | 15.9 | 15.5 | 15.1 | 15 | 14.8 | 14.7 | 14.5 | 0 | 14.3 | 14.1 | 14 | 13.9 | 13.8 | 13.7 | 13.6 | 13.5 |
| | 0.65 | 12.9 | 17.1 | 16.4 | 16.3 | 16.2 | 15.8 | 15.5 | 15.2 | 15 | 14.9 | 14.7 | 14.6 | 14.4 | 0 | 14.2 | 14 | 13.9 | 13.8 | 13.7 | 13.6 | 13.5 |
| | 0.70 | 12.9 | 17 | 16.1 | 16 | 16 | 15.7 | 15.5 | 15.3 | 15.1 | 14.9 | 14.8 | 14.6 | 14.4 | 14.3 | 0 | 14.1 | 14 | 13.8 | 13.7 | 13.6 | 13.5 |
| | 0.75 | 12.9 | 16.8 | 15.8 | 15.8 | 15.8 | 15.7 | 15.5 | 15.4 | 15.2 | 15 | 14.8 | 14.6 | 14.4 | 14.3 | 14.2 | 0 | 14 | 13.9 | 13.8 | 13.7 | 13.6 |
| | 0.80 | 12.9 | 16.7 | 15.9 | 15.8 | 15.8 | 15.6 | 15.4 | 15.3 | 15.1 | 14.9 | 14.7 | 14.5 | 14.4 | 14.3 | 14.2 | 14.1 | 0 | 13.9 | 13.8 | 13.7 | 13.6 |
| | 0.85 | 12.9 | 16.5 | 15.9 | 15.8 | 15.7 | 15.5 | 15.3 | 15.2 | 14.9 | 14.7 | 14.5 | 14.4 | 14.3 | 14.3 | 14.2 | 14.1 | 14 | 0 | 13.8 | 13.7 | 13.6 |
| | 0.90 | 12.9 | 16.4 | 15.9 | 15.8 | 15.7 | 15.5 | 15.3 | 15.1 | 14.8 | 14.6 | 14.4 | 14.3 | 14.3 | 14.2 | 14.2 | 14.1 | 14.1 | 14 | 0 | 13.8 | 13.6 |
| | 0.95 | 12.9 | 16.3 | 15.9 | 15.8 | 15.7 | 15.4 | 15.2 | 14.9 | 14.7 | 14.5 | 14.3 | 14.2 | 14.2 | 14.2 | 14.2 | 14.2 | 14.1 | 14 | 14 | 0 | 13.7 |
| | 1.00 | 12.9 | 16.1 | 15.9 | 15.8 | 15.7 | 15.4 | 15.1 | 14.8 | 14.6 | 14.3 | 14.1 | 14.1 | 14.2 | 14.2 | 14.2 | 14.3 | 14.2 | 14.1 | 14.1 | 14 | 0 |

FIG. 8

T2

| | | GRADATION AT THE END | | | | | | | | | | | | | | | |
|---|---|---|---|---|---|---|---|---|---|---|---|---|---|---|---|---|---|
| GRADATION AT THE BEGINNING | DIVISIONAL SUB-PIXEL | 0 | 17 | 34 | 51 | 68 | 85 | 102 | 119 | 136 | 153 | 170 | 187 | 204 | 221 | 238 | 255 |
| | A 0 | 0 | 18 | 34 | 51 | 53 | 0 | 0 | 0 | 38 | 38 | 0 | 31 | 204 | 221 | 238 | 255 |
| | B 0 | 0 | 18 | 34 | 51 | 80 | 116 | 140 | 163 | 184 | 207 | 233 | 255 | 204 | 221 | 238 | 255 |
| | A 0 | 0 | 15 | 34 | 51 | 53 | 0 | 0 | 0 | 0 | 0 | 0 | 255 | 204 | 221 | 238 | 255 |
| | B 17 | 0 | 21 | 34 | 51 | 80 | 116 | 140 | 163 | 186 | 210 | 233 | 31 | 204 | 221 | 238 | 255 |
| | A 0 | 0 | 0 | 28 | 49 | 53 | 0 | 0 | 0 | 0 | 0 | 0 | 255 | 205 | 221 | 238 | 255 |
| | B 34 | 0 | 25 | 39 | 53 | 80 | 116 | 140 | 163 | 186 | 210 | 233 | 31 | 203 | 221 | 238 | 255 |
| | A 0 | 0 | 23 | 0 | 41 | 55 | 49 | 0 | 0 | 0 | 0 | 0 | 253 | 206 | 224 | 239 | 255 |
| | B 51 | 0 | 11 | 47 | 59 | 79 | 108 | 140 | 163 | 186 | 210 | 233 | 48 | 202 | 218 | 237 | 255 |
| | A 0 | 0 | 0 | 0 | 11 | 40 | 27 | 0 | 0 | 0 | 0 | 0 | 255 | 212 | 225 | 238 | 255 |
| | B 68 | 0 | 25 | 47 | 69 | 87 | 114 | 140 | 163 | 186 | 210 | 233 | 33 | 195 | 217 | 238 | 255 |
| | A 0 | 0 | 0 | 23 | 0 | 30 | 0 | 39 | 0 | 0 | 0 | 0 | 254 | 213 | 225 | 238 | 255 |
| | B 85 | 0 | 25 | 42 | 70 | 90 | 116 | 136 | 163 | 186 | 210 | 233 | 40 | 194 | 217 | 238 | 255 |
| | A 0 | 0 | 23 | 34 | 0 | 0 | 34 | 42 | 0 | 0 | 0 | 0 | 31 | 215 | 225 | 239 | 255 |
| | B 102 | 0 | 11 | 34 | 70 | 93 | 113 | 135 | 163 | 186 | 210 | 233 | 255 | 193 | 217 | 237 | 255 |
| | A 0 | 0 | 23 | 35 | 41 | 0 | 0 | 40 | 0 | 0 | 0 | 0 | 31 | 255 | 228 | 239 | 255 |
| | B 119 | 0 | 11 | 33 | 59 | 93 | 116 | 136 | 163 | 186 | 210 | 233 | 255 | 129 | 214 | 237 | 255 |
| | A 0 | 0 | 23 | 35 | 43 | 31 | 42 | 23 | 0 | 0 | 34 | 0 | 31 | 254 | 229 | 237 | 255 |
| | B 136 | 0 | 11 | 33 | 58 | 90 | 111 | 138 | 163 | 186 | 208 | 233 | 255 | 132 | 213 | 238 | 255 |
| | A 0 | 0 | 23 | 37 | 42 | 0 | 0 | 0 | 31 | 15 | 34 | 0 | 31 | 246 | 250 | 236 | 255 |
| | B 153 | 0 | 11 | 31 | 58 | 93 | 116 | 140 | 161 | 186 | 208 | 233 | 255 | 148 | 186 | 240 | 255 |
| | A 0 | 0 | 23 | 35 | 42 | 0 | 0 | 0 | 0 | 33 | 34 | 0 | 31 | 238 | 254 | 237 | 255 |
| | B 170 | 0 | 11 | 33 | 58 | 93 | 116 | 140 | 163 | 185 | 208 | 233 | 255 | 162 | 181 | 239 | 255 |
| | A 0 | 0 | 23 | 34 | 41 | 0 | 0 | 0 | 37 | 0 | 0 | 0 | 31 | 227 | 253 | 239 | 255 |
| | B 187 | 0 | 11 | 34 | 59 | 93 | 116 | 140 | 160 | 186 | 210 | 233 | 255 | 177 | 182 | 237 | 255 |
| | A 0 | 0 | 23 | 35 | 40 | 0 | 0 | 0 | 0 | 0 | 28 | 0 | 31 | 220 | 243 | 238 | 255 |
| | B 204 | 0 | 11 | 33 | 60 | 93 | 116 | 140 | 163 | 186 | 208 | 233 | 255 | 186 | 196 | 237 | 255 |
| | A 0 | 0 | 23 | 35 | 39 | 28 | 0 | 0 | 0 | 0 | 0 | 0 | 31 | 219 | 232 | 255 | 255 |
| | B 221 | 0 | 11 | 33 | 60 | 90 | 116 | 140 | 163 | 186 | 210 | 233 | 255 | 187 | 210 | 219 | 255 |
| | A 0 | 0 | 23 | 34 | 39 | 0 | 0 | 0 | 0 | 0 | 0 | 0 | 31 | 223 | 230 | 245 | 255 |
| | B 238 | 0 | 11 | 34 | 60 | 93 | 116 | 140 | 163 | 186 | 210 | 233 | 255 | 182 | 211 | 231 | 255 |
| | A 0 | 0 | 23 | 33 | 39 | 0 | 0 | 0 | 0 | 15 | 34 | 233 | 31 | 227 | 250 | 233 | 255 |
| | B 255 | 0 | 11 | 35 | 60 | 93 | 116 | 140 | 163 | 186 | 208 | 11 | 255 | 178 | 186 | 243 | 255 |
| | A 17 | 0 | 21 | 34 | 51 | 80 | 116 | 0 | 163 | 186 | 207 | 0 | 31 | 204 | 221 | 238 | 255 |
| | B 0 | 0 | 15 | 34 | 51 | 53 | 11 | 140 | 11 | 11 | 38 | 233 | 255 | 204 | 221 | 238 | 255 |
| | A 17 | 0 | 18 | 34 | 51 | 53 | 0 | 0 | 0 | 0 | 0 | 0 | 31 | 204 | 221 | 238 | 255 |
| | B 17 | 0 | 18 | 34 | 51 | 80 | 116 | 140 | 163 | 186 | 210 | 233 | 255 | 204 | 221 | 238 | 255 |
| | A 17 | 0 | 0 | 30 | 49 | 53 | 0 | 0 | 0 | 0 | 0 | 0 | 255 | 205 | 221 | 238 | 255 |
| | B 34 | 0 | 25 | 38 | 53 | 80 | 116 | 140 | 163 | 186 | 210 | 233 | 31 | 203 | 221 | 238 | 255 |
| | A 17 | 0 | 23 | 0 | 41 | 56 | 49 | 0 | 0 | 0 | 0 | 0 | 253 | 206 | 224 | 239 | 255 |
| | B 51 | 0 | 11 | 47 | 59 | 79 | 108 | 140 | 163 | 186 | 210 | 233 | 48 | 202 | 218 | 237 | 255 |
| | A 17 | 0 | 0 | 0 | 18 | 41 | 27 | 0 | 0 | 0 | 0 | 0 | 255 | 212 | 225 | 238 | 255 |
| | B 68 | 0 | 25 | 47 | 68 | 86 | 114 | [illegible] | [illegible] | [illegible] | [illegible] | [illegible] | [illegible] | [illegible] | [illegible] | [illegible] | 255 |
| | A [illegible] | [illegible] | [illegible] | [illegible] | [illegible] | 93 | 116 | 139 | 163 | 186 | 208 | 0 | 255 | 178 | 186 | 243 | 255 |
| | B 0 | 0 | 25 | 33 | 39 | 11 | 11 | 11 | 11 | 15 | 34 | 233 | 31 | 227 | 250 | 233 | 255 |
| | A 255 | 0 | 0 | 34 | 60 | 93 | 116 | 139 | 163 | 186 | 208 | 0 | 255 | 178 | 186 | 243 | 255 |
| | B 17 | 0 | 25 | 34 | 39 | 11 | 11 | 11 | 11 | 15 | 35 | 233 | 31 | 227 | 250 | 233 | 255 |
| | A 255 | 0 | 0 | 27 | 58 | 93 | 116 | 139 | 163 | 186 | 207 | 0 | 255 | 178 | 186 | 243 | 255 |
| | B 34 | 0 | 25 | 40 | 43 | 11 | 11 | 11 | 11 | 15 | 41 | 233 | 34 | 226 | 250 | 233 | 255 |
| | A 255 | 0 | 23 | 0 | 46 | 93 | 116 | 139 | 163 | 183 | 205 | 0 | 253 | 181 | 186 | 243 | 255 |
| | B 51 | 0 | 11 | 47 | 56 | 11 | 11 | 11 | 11 | 45 | 55 | 233 | 49 | 224 | 250 | 233 | 255 |
| | A 255 | 0 | 0 | 0 | 0 | 48 | 116 | 139 | 163 | 186 | 202 | 0 | 252 | 183 | 186 | 243 | 255 |
| | B 68 | 0 | 25 | 47 | 70 | 83 | 11 | 11 | 11 | 15 | 65 | 233 | 56 | 223 | 250 | 232 | 255 |
| | A 255 | 0 | 0 | 0 | 0 | 21 | 116 | 139 | 163 | 186 | 194 | 0 | 254 | 182 | 186 | 243 | 255 |
| | B 85 | 0 | 25 | 47 | 70 | 92 | 11 | 11 | 11 | 15 | 90 | 233 | 42 | 223 | 250 | 232 | 255 |
| | A 255 | 0 | 23 | 37 | 49 | 0 | 35 | 139 | 163 | 186 | 186 | 0 | 244 | 184 | 186 | 243 | 255 |
| | B 102 | 0 | 11 | 31 | 53 | 93 | 112 | 11 | 11 | 15 | 108 | 233 | 90 | 222 | 250 | 232 | 255 |
| | A 255 | 0 | 23 | 42 | 56 | 0 | 0 | 53 | 163 | 186 | 186 | 0 | 31 | 186 | 186 | 244 | 255 |
| | B 119 | 0 | 11 | 23 | 45 | 93 | 116 | 132 | 11 | 11 | 108 | 233 | 255 | 220 | 250 | 232 | 255 |
| | A 255 | 0 | 21 | 39 | 58 | 93 | 116 | 0 | 163 | 186 | 208 | 0 | 31 | 253 | 186 | 243 | 255 |
| | B 136 | 0 | 15 | 28 | 43 | 11 | 11 | 140 | 11 | 15 | 30 | 233 | 255 | 134 | 250 | 233 | 255 |
| | A 255 | 0 | 23 | 46 | 58 | 93 | 116 | 0 | 27 | 15 | 40 | 186 | 31 | 246 | 250 | 239 | 255 |
| | B 153 | 0 | 11 | 11 | 42 | 11 | 11 | 140 | 162 | 186 | 207 | 152 | 255 | 148 | 186 | 237 | 255 |
| | A 255 | 0 | 23 | 41 | 57 | 93 | 116 | 139 | 0 | 31 | 209 | 0 | 31 | 238 | 254 | 243 | 255 |
| | B 170 | 0 | 11 | 25 | 44 | 11 | 11 | 11 | 163 | 185 | 25 | 233 | 255 | 161 | 181 | 233 | 255 |
| | A 255 | 0 | 23 | 38 | 56 | 93 | 116 | 139 | 163 | 0 | 208 | 0 | 31 | 186 | 252 | 244 | 255 |
| | B 187 | 0 | 11 | 30 | 46 | 11 | 11 | 11 | 11 | 186 | 33 | 233 | 255 | 220 | 184 | 232 | 255 |
| | A 255 | 0 | 23 | 40 | 55 | 93 | 116 | 139 | 163 | 186 | 11 | 0 | 31 | 186 | 244 | 243 | 255 |
| | B 204 | 0 | 11 | 27 | 47 | 11 | 11 | 11 | 11 | 15 | 210 | 233 | 255 | 220 | 195 | 232 | 255 |
| | A 255 | 0 | 23 | 41 | 53 | 93 | 116 | 139 | 163 | 186 | 0 | 0 | 31 | 186 | 186 | 254 | 255 |
| | B 221 | 0 | 11 | 25 | 49 | 11 | 11 | 11 | 11 | 11 | 210 | 233 | 255 | 220 | 250 | 221 | 255 |
| | A 255 | 0 | 23 | 37 | 52 | 0 | 116 | 139 | 163 | 186 | 208 | 0 | 31 | 185 | 186 | 245 | 255 |
| | B 238 | 0 | 11 | 31 | 50 | 93 | 11 | 11 | 11 | 15 | 37 | 233 | 255 | 221 | 250 | 231 | 255 |
| | A 255 | 0 | 18 | 34 | 51 | 0 | 0 | 0 | 0 | 15 | 40 | 0 | 31 | 204 | 186 | 238 | 255 |
| | B 255 | 0 | 18 | 34 | 51 | 93 | 116 | 140 | 163 | 186 | 207 | 233 | 255 | 204 | 250 | 238 | 255 |

FIG. 15 (a)
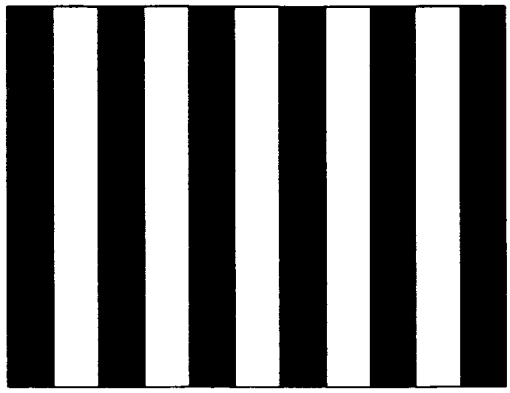
FIG. 15 (b)
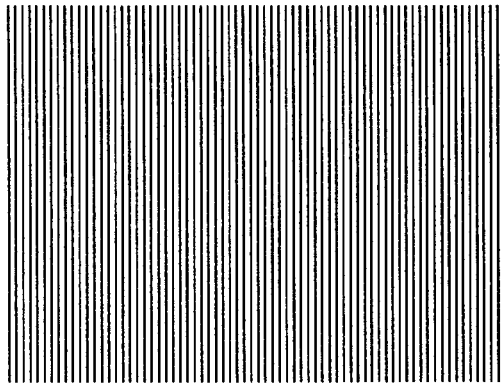
FIG. 16
| R | G | B | R | G | B |
|---|---|---|---|---|---|
| +4 | 0 | −4 | +2 | 0 | −4 |
| −2 | −1 | +8 | −4 | +1 | 0 |

FIG. 18

SPATIAL DIFFUSION TABLE 1

| VERTICAL PIXEL | HORIZONTAL PIXEL | 1 | | | 2 | | | 3 | | | 4 | | | 5 | | | 6 | | | 7 | | | 8 | | |
|---|---|---|---|---|---|---|---|---|---|---|---|---|---|---|---|---|---|---|---|---|---|---|---|---|---|
| | COLOR | R | G | B | R | G | B | R | G | B | R | G | B | R | G | B | R | G | B | R | G | B | R | G | B |
| 1 | | 5 | 2 | 6 | 3 | -1 | -7 | 6 | 0 | -11 | -2 | 1 | -11 | -3 | 5 | -7 | -8 | 6 | 12 | 1 | 5 | 4 | -5 | 4 | 8 |
| 2 | | 7 | -4 | -2 | 6 | 0 | -3 | 5 | -4 | -12 | -3 | -2 | 3 | 5 | -4 | -10 | -7 | 2 | -2 | 5 | -2 | -8 | 8 | 5 | 2 |
| 3 | | 2 | -6 | -1 | -2 | 5 | 0 | -2 | -5 | 5 | 4 | -3 | -8 | -8 | -6 | -9 | 1 | -5 | 0 | 2 | 2 | 3 | -3 | 4 | -4 |
| 4 | | 3 | 5 | 5 | 2 | 4 | 0 | 5 | -2 | 0 | -8 | 5 | 7 | 8 | 6 | 0 | 4 | -5 | -11 | 7 | 1 | -6 | 5 | -3 | -4 |
| 5 | | -6 | 1 | 6 | -5 | -6 | 6 | -6 | -6 | 9 | -2 | 4 | 7 | -1 | -3 | 5 | 8 | 3 | -10 | -5 | -5 | 12 | 5 | -6 | -7 |
| 6 | | -5 | 3 | 2 | -4 | -3 | -9 | 1 | 2 | 4 | -6 | 2 | -7 | -8 | -6 | 10 | 2 | -3 | 10 | -4 | -5 | 11 | -5 | -5 | -10 |
| 7 | | 8 | 3 | 1 | -8 | 2 | 7 | -8 | 5 | -9 | 6 | 0 | -7 | -3 | 6 | -7 | 3 | 2 | -2 | -5 | 0 | 6 | 1 | 2 | -4 |
| 8 | | 7 | 4 | -2 | 7 | -1 | 2 | -5 | -4 | 9 | -8 | -3 | 11 | -4 | 6 | 0 | -2 | -6 | 8 | 7 | 6 | 2 | 2 | 1 | 7 |

SPATIAL DIFFUSION TABLE 2

| VERTICAL PIXEL | HORIZONTAL PIXEL | 1 | | | 2 | | | 3 | | | 4 | | | 5 | | | 6 | | | 7 | | | 8 | | |
|---|---|---|---|---|---|---|---|---|---|---|---|---|---|---|---|---|---|---|---|---|---|---|---|---|---|
| | COLOR | R | G | B | R | G | B | R | G | B | R | G | B | R | G | B | R | G | B | R | G | B | R | G | B |
| 1 | | 4 | 1 | -1 | 8 | 5 | 8 | 4 | 4 | 6 | 7 | -5 | 3 | 0 | 6 | -4 | 6 | -5 | 5 | -8 | 4 | 5 | 5 | 5 | 2 |
| 2 | | 7 | -4 | 7 | -3 | 1 | 8 | 5 | -4 | -10 | -7 | 2 | -12 | -6 | 5 | -1 | 1 | 4 | -5 | -4 | 2 | -1 | -7 | -2 | 5 |
| 3 | | 2 | 5 | 1 | -7 | -1 | 12 | -2 | 6 | -7 | -4 | -6 | -9 | 5 | -3 | 5 | -1 | -5 | -9 | -6 | 5 | 6 | 4 | -1 | 8 |
| 4 | | 2 | -1 | -11 | -6 | -1 | 0 | 5 | -4 | 3 | -3 | 6 | 12 | 2 | -2 | 6 | 2 | 0 | -9 | 7 | 4 | -3 | -8 | 3 | -11 |
| 5 | | -8 | -3 | 4 | 5 | 0 | 6 | -4 | -5 | 11 | 1 | -3 | 12 | 3 | 6 | -2 | 2 | 0 | 1 | -7 | -1 | -11 | -5 | -3 | 0 |
| 6 | | 4 | -3 | -8 | -4 | -6 | -3 | 3 | -1 | 3 | -3 | -1 | 9 | -3 | 3 | -6 | 6 | -4 | 1 | -6 | -2 | 4 | -3 | 1 | 11 |
| 7 | | -2 | 5 | -10 | 8 | 1 | 3 | -2 | -5 | 11 | 1 | -5 | 2 | -1 | 3 | -6 | 3 | -6 | -9 | 2 | 1 | -2 | 6 | 4 | -12 |
| 8 | | -2 | 0 | -1 | 5 | -5 | -2 | -5 | -1 | 5 | 4 | 3 | -3 | -1 | 0 | -11 | 4 | 6 | 5 | -1 | 2 | -9 | -4 | -5 | -2 |

SPATIAL DIFFUSION TABLE 3

| VERTICAL PIXEL | HORIZONTAL PIXEL | 1 | | | 2 | | | 3 | | | 4 | | | 5 | | | 6 | | | 7 | | | 8 | | |
|---|---|---|---|---|---|---|---|---|---|---|---|---|---|---|---|---|---|---|---|---|---|---|---|---|---|
| | COLOR | R | G | B | R | G | B | R | G | B | R | G | B | R | G | B | R | G | B | R | G | B | R | G | B |
| 1 | | 4 | -5 | 11 | 5 | 0 | -1 | -2 | 6 | -4 | -3 | 4 | 1 | 1 | 3 | -5 | -6 | -2 | 5 | 2 | 5 | 3 | -1 | -4 | 7 |
| 2 | | 2 | 6 | 1 | -7 | -3 | -4 | 2 | 4 | 3 | -6 | -4 | 11 | -5 | 6 | 5 | 0 | 3 | -8 | 1 | 4 | 3 | 3 | 0 | 6 |
| 3 | | 8 | -1 | -10 | -5 | -2 | 7 | -7 | 5 | 8 | 5 | -2 | -1 | 1 | -6 | -2 | 6 | 2 | -9 | -7 | 4 | 8 | 6 | -1 | 0 |
| 4 | | -7 | 2 | 11 | 3 | -6 | -8 | -6 | 5 | 4 | 8 | -5 | 3 | 3 | -2 | 0 | -3 | 0 | -12 | 5 | 2 | 0 | -3 | 0 | 4 |
| 5 | | -3 | -1 | -9 | 8 | -4 | 12 | -5 | 0 | -8 | -5 | -5 | -12 | -7 | 1 | -4 | 5 | -3 | 2 | -7 | -6 | -1 | 8 | 6 | 6 |
| 6 | | 7 | -6 | 7 | -3 | -3 | -12 | -8 | -6 | -11 | 7 | -1 | 6 | 6 | -1 | 9 | 7 | 0 | -7 | -3 | 3 | -9 | 1 | -5 | -1 |
| 7 | | 4 | 3 | -1 | 0 | 0 | 9 | -1 | 2 | -4 | 8 | 5 | -6 | 8 | -1 | -5 | -4 | 2 | 12 | -5 | -3 | 11 | -3 | -6 | 4 |
| 8 | | -2 | -1 | -3 | 4 | 4 | -7 | -3 | -5 | 1 | -3 | 5 | 1 | 2 | -2 | 3 | -4 | 5 | -12 | -3 | 0 | -8 | -3 | 5 | 0 |

SPATIAL DIFFUSION TABLE 4

| VERTICAL PIXEL | HORIZONTAL PIXEL | 1 | | | 2 | | | 3 | | | 4 | | | 5 | | | 6 | | | 7 | | | 8 | | |
|---|---|---|---|---|---|---|---|---|---|---|---|---|---|---|---|---|---|---|---|---|---|---|---|---|---|
| | COLOR | R | G | B | R | G | B | R | G | B | R | G | B | R | G | B | R | G | B | R | G | B | R | G | B |
| 1 | | -5 | -3 | 12 | 0 | -3 | -7 | -8 | 2 | -11 | 0 | -3 | 12 | -3 | 4 | -7 | 1 | 3 | -6 | 8 | 6 | -10 | 8 | -5 | 8 |
| 2 | | 6 | 0 | 5 | 7 | -1 | 9 | -2 | 5 | -7 | 7 | -4 | -3 | -4 | -3 | -11 | 5 | -1 | 3 | -6 | -3 | 11 | -6 | -3 | -12 |
| 3 | | 0 | -5 | -7 | -6 | 0 | -1 | 0 | 3 | 8 | -5 | -5 | 3 | -7 | 2 | 11 | -1 | -5 | -12 | 8 | -2 | -11 | -6 | 6 | 3 |
| 4 | | 7 | -3 | 4 | -5 | -6 | 2 | -6 | 6 | 6 | -1 | 2 | -2 | 7 | -2 | -6 | -7 | 5 | 10 | 8 | 5 | -9 | 6 | -1 | 1 |
| 5 | | 2 | -3 | 6 | 0 | -2 | -10 | -1 | 6 | 1 | 8 | 2 | 7 | 1 | -4 | -12 | -8 | 2 | 12 | 6 | 1 | 6 | -8 | -4 | 1 |
| 6 | | -1 | 6 | 1 | -8 | 3 | -5 | -1 | 4 | 4 | -8 | -6 | -12 | 7 | -6 | -9 | 2 | 1 | 3 | 1 | -1 | -1 | -4 | 3 | -2 |
| 7 | | 3 | 3 | 8 | -2 | 0 | 12 | 5 | 5 | 4 | -4 | 0 | -10 | 7 | 3 | -4 | 7 | -1 | 7 | 1 | 3 | 2 | 8 | 4 | 10 |
| 8 | | -1 | 3 | 8 | -4 | -2 | 1 | 5 | -4 | -4 | -5 | -5 | -8 | -4 | -1 | 9 | 2 | -2 | -8 | -8 | 0 | 4 | 2 | 1 | -7 |

SPATIAL DIFFUSION TABLE 5

| VERTICAL PIXEL | HORIZONTAL PIXEL | 1 | | | 2 | | | 3 | | | 4 | | | 5 | | | 6 | | | 7 | | | 8 | | |
|---|---|---|---|---|---|---|---|---|---|---|---|---|---|---|---|---|---|---|---|---|---|---|---|---|---|
| | COLOR | R | G | B | R | G | B | R | G | B | R | G | B | R | G | B | R | G | B | R | G | B | R | G | B |
| 1 | | -6 | -6 | -9 | -5 | -5 | 9 | 1 | -4 | -12 | 3 | 0 | 5 | 3 | -4 | -3 | -3 | -4 | 5 | -2 | -6 | 7 | 6 | -6 | -4 |
| 2 | | -5 | -4 | 2 | -6 | -4 | -12 | 1 | -2 | -2 | -8 | -1 | -2 | 7 | 6 | 10 | 3 | -1 | 10 | -2 | 1 | 7 | -1 | 0 | -9 |
| 3 | | 0 | 1 | -11 | 0 | 3 | 7 | -5 | -3 | -6 | -8 | 1 | -2 | -7 | -5 | 3 | -4 | -4 | -4 | 1 | -1 | 4 | -5 | 1 | 5 |
| 4 | | 1 | 4 | 5 | -5 | 6 | -12 | -1 | 2 | 7 | 8 | 2 | -9 | 0 | 3 | -1 | 5 | 2 | 4 | 7 | 6 | 9 | -7 | 1 | -4 |
| 5 | | 5 | -6 | -5 | 8 | -1 | 6 | 8 | -1 | 3 | -3 | 2 | 4 | -2 | 1 | 0 | 7 | 3 | -11 | -7 | -5 | -6 | 4 | 1 | 0 |
| 6 | | -3 | 0 | 10 | 1 | 2 | -10 | -8 | 5 | 4 | -8 | -1 | -10 | 8 | 4 | -2 | 3 | 3 | 10 | 1 | 1 | 10 | 2 | 1 | 6 |
| 7 | | 4 | 6 | -5 | 8 | 1 | 0 | -6 | -4 | 2 | 8 | 3 | 1 | -1 | -4 | 6 | 1 | -3 | 10 | -2 | 3 | 0 | 4 | -2 | -8 |
| 8 | | -6 | 5 | 4 | -3 | 5 | -6 | 5 | 2 | 3 | -7 | -3 | 5 | 2 | 5 | -12 | 0 | -5 | 4 | 6 | -2 | -7 | 5 | 5 | -3 |

SPATIAL DIFFUSION TABLE 6

| VERTICAL PIXEL | HORIZONTAL PIXEL | 1 | | | 2 | | | 3 | | | 4 | | | 5 | | | 6 | | | 7 | | | 8 | | |
|---|---|---|---|---|---|---|---|---|---|---|---|---|---|---|---|---|---|---|---|---|---|---|---|---|---|
| | COLOR | R | G | B | R | G | B | R | G | B | R | G | B | R | G | B | R | G | B | R | G | B | R | G | B |
| 1 | | 1 | -1 | -6 | 8 | 0 | -2 | 1 | -5 | 8 | 4 | -1 | 9 | 5 | -5 | 12 | -6 | 1 | -3 | -3 | 0 | 2 | 2 | -6 | -11 |
| 2 | | 6 | 2 | 12 | -2 | -3 | -11 | 2 | -1 | 11 | 1 | 4 | -1 | -1 | 2 | -3 | 5 | 5 | 7 | 2 | -4 | 2 | 6 | 0 | -4 |
| 3 | | -6 | 6 | -6 | 4 | 5 | 1 | -8 | 0 | 5 | 7 | -2 | -8 | 3 | 0 | 6 | 3 | 2 | -1 | -5 | 1 | 6 | 8 | -5 | 5 |
| 4 | | -3 | 5 | -1 | -4 | 5 | 4 | 6 | -3 | -8 | -1 | 6 | -10 | -8 | -6 | 9 | -6 | 3 | -6 | -4 | -2 | 5 | -2 | 2 | 4 |
| 5 | | -3 | 1 | -12 | -7 | -1 | 7 | -2 | -2 | -5 | -3 | -4 | -11 | 0 | 3 | -10 | 7 | -1 | 5 | -2 | -6 | -2 | 8 | 1 | -7 |
| 6 | | 8 | -2 | 12 | -4 | 0 | -12 | 8 | 3 | -6 | -2 | -6 | -9 | -3 | -3 | -6 | -5 | -4 | 8 | 1 | 1 | 0 | 2 | -6 | -10 |
| 7 | | -1 | 4 | 6 | 1 | 5 | 9 | -7 | 0 | 11 | -4 | 3 | 3 | 7 | 1 | 6 | 0 | 1 | -10 | -3 | 3 | 8 | -8 | -5 | -3 |
| 8 | | 8 | -6 | 5 | 2 | 5 | -11 | -1 | 2 | 8 | -2 | 6 | 3 | -4 | -4 | 11 | -3 | 6 | -6 | -6 | -1 | -9 | 3 | 1 | 0 |

⋮

FIG. 19

SPATIAL DIFFUSION TABLE 27

| VERTICAL PIXEL | HORIZONTAL PIXEL | 1 | | | 2 | | | 3 | | | 4 | | | 5 | | | 6 | | | 7 | | | 8 | | |
|---|---|---|---|---|---|---|---|---|---|---|---|---|---|---|---|---|---|---|---|---|---|---|---|---|---|
| | COLOR | R | G | B | R | G | B | R | G | B | R | G | B | R | G | B | R | G | B | R | G | B | R | G | B |
| 1 | | 5 | -1 | 3 | -5 | 6 | 8 | -6 | 4 | 9 | -3 | -5 | 12 | -7 | -3 | 4 | 1 | 1 | 7 | 0 | -4 | -8 | 1 | 3 | -7 |
| 2 | | -1 | 1 | 0 | -8 | 6 | -6 | 0 | 0 | 12 | -5 | 2 | 11 | 8 | -2 | -2 | 3 | 5 | -8 | -4 | -4 | -1 | 7 | -3 | 10 |
| 3 | | -3 | -5 | -9 | 6 | -1 | -7 | -5 | -2 | -10 | -7 | -5 | 8 | -1 | -4 | 12 | -2 | 3 | -11 | -5 | -3 | 2 | -4 | 1 | 10 |
| 4 | | 5 | 6 | 0 | 7 | 6 | 1 | 8 | -2 | -2 | 4 | -3 | 6 | -2 | -2 | -7 | 1 | -2 | 1 | -3 | 5 | -11 | -5 | 1 | -3 |
| 5 | | -7 | -2 | -7 | 6 | -5 | 2 | -5 | 5 | -1 | 2 | -3 | -4 | -2 | 3 | -7 | 4 | -6 | -10 | 2 | 3 | 6 | 0 | -2 | 10 |
| 6 | | 1 | 3 | 6 | -5 | -2 | 10 | -7 | -2 | -2 | 7 | 1 | 12 | 4 | 2 | -12 | 8 | 2 | -6 | 3 | -6 | -8 | -4 | 4 | 6 |
| 7 | | -7 | -5 | 1 | -7 | 2 | 2 | 0 | -1 | 0 | -2 | 5 | -8 | 5 | -2 | 6 | -1 | -2 | 11 | 4 | -2 | -3 | 7 | 4 | -8 |
| 8 | | 0 | 5 | 12 | -3 | -3 | -8 | 3 | -2 | -12 | 2 | 5 | 12 | 1 | 3 | -5 | 4 | 1 | -5 | 1 | 3 | -5 | 6 | -5 | -9 |

SPATIAL DIFFUSION TABLE 28

| VERTICAL PIXEL | HORIZONTAL PIXEL | 1 | | | 2 | | | 3 | | | 4 | | | 5 | | | 6 | | | 7 | | | 8 | | |
|---|---|---|---|---|---|---|---|---|---|---|---|---|---|---|---|---|---|---|---|---|---|---|---|---|---|
| | COLOR | R | G | B | R | G | B | R | G | B | R | G | B | R | G | B | R | G | B | R | G | B | R | G | B |
| 1 | | 0 | 0 | -4 | 7 | 3 | 7 | 1 | 6 | -3 | -5 | 2 | -8 | 3 | -1 | 2 | -1 | 5 | 1 | 5 | 5 | 12 | -7 | 2 | -7 |
| 2 | | -2 | -3 | 1 | -6 | -2 | -6 | 6 | 0 | 2 | 5 | 0 | -7 | 0 | 2 | 8 | -7 | -1 | 10 | -8 | 5 | 9 | -4 | 4 | -6 |
| 3 | | 8 | -5 | -5 | 6 | 6 | 10 | 0 | 2 | 1 | -3 | 1 | 10 | 6 | 1 | 4 | 8 | 6 | 2 | 2 | -2 | 6 | 1 | 3 | -12 |
| 4 | | 3 | -2 | 3 | 4 | -6 | 3 | 5 | -5 | 4 | 5 | -4 | -2 | -1 | -5 | 4 | -8 | -2 | -5 | -2 | -6 | -3 | 1 | -2 | -11 |
| 5 | | 2 | -5 | -4 | -5 | -4 | -12 | -1 | 2 | -11 | 5 | 1 | -7 | -4 | 3 | -10 | -5 | -2 | -9 | -7 | 3 | 0 | -6 | 0 | 1 |
| 6 | | -8 | -6 | 10 | 4 | 3 | 8 | -1 | -1 | -10 | -6 | -1 | 7 | 6 | 1 | -10 | 2 | 4 | 5 | 2 | 0 | 7 | 6 | 2 | -8 |
| 7 | | -8 | 4 | -7 | -6 | -4 | 4 | 1 | -5 | -10 | -5 | -5 | 7 | 6 | -6 | -7 | 6 | 6 | 10 | 7 | -4 | -2 | 5 | 1 | 9 |
| 8 | | -8 | -2 | -5 | -8 | -3 | -12 | -7 | 2 | 4 | 5 | 2 | 2 | -4 | -6 | 6 | 5 | 5 | 7 | -2 | 5 | 8 | 7 | 3 | 9 |

SPATIAL DIFFUSION TABLE 29

| VERTICAL PIXEL | HORIZONTAL PIXEL | 1 | | | 2 | | | 3 | | | 4 | | | 5 | | | 6 | | | 7 | | | 8 | | |
|---|---|---|---|---|---|---|---|---|---|---|---|---|---|---|---|---|---|---|---|---|---|---|---|---|---|
| | COLOR | R | G | B | R | G | B | R | G | B | R | G | B | R | G | B | R | G | B | R | G | B | R | G | B |
| 1 | | -2 | 3 | 0 | 8 | -3 | -6 | 2 | -4 | -7 | 8 | -1 | 0 | -4 | 4 | 0 | -3 | 3 | 7 | -2 | 1 | 10 | 6 | -1 | -6 |
| 2 | | 3 | 2 | 8 | -1 | -1 | 3 | -2 | -6 | -1 | -4 | 5 | -3 | 0 | 1 | -12 | 0 | -2 | 0 | 3 | -4 | 2 | 0 | -1 | 7 |
| 3 | | 4 | -4 | 8 | 4 | -4 | 0 | 4 | 2 | -10 | 2 | 2 | -12 | -3 | 2 | -11 | 7 | -4 | 11 | -2 | 1 | -1 | 8 | 0 | 10 |
| 4 | | -6 | -1 | -7 | -3 | 3 | -1 | -5 | -4 | 9 | -1 | -5 | 12 | 6 | 3 | -1 | -1 | 0 | 0 | 1 | 0 | 5 | 0 | -5 | -6 |
| 5 | | 4 | 6 | -11 | -2 | -3 | -2 | -5 | -5 | 8 | 6 | -6 | 5 | 5 | 5 | -6 | -1 | 6 | -10 | -7 | -5 | 11 | -2 | 1 | -10 |
| 6 | | 1 | -3 | 10 | 3 | 5 | 4 | -1 | 5 | 10 | -3 | -2 | 8 | 0 | 0 | 2 | 4 | -5 | 3 | 2 | 0 | -7 | 3 | 5 | -9 |
| 7 | | -1 | -1 | -12 | -6 | 5 | -2 | -4 | 2 | 2 | -5 | -3 | -3 | 6 | 5 | -12 | -8 | -4 | 10 | 6 | 1 | 4 | -1 | 4 | -8 |
| 8 | | -6 | 6 | -10 | -5 | -1 | -6 | -8 | 1 | 0 | -1 | -1 | 11 | 2 | 1 | 9 | -7 | 0 | 6 | -3 | 2 | 4 | 7 | -3 | -7 |

SPATIAL DIFFUSION TABLE 30

| VERTICAL PIXEL | HORIZONTAL PIXEL | 1 | | | 2 | | | 3 | | | 4 | | | 5 | | | 6 | | | 7 | | | 8 | | |
|---|---|---|---|---|---|---|---|---|---|---|---|---|---|---|---|---|---|---|---|---|---|---|---|---|---|
| | COLOR | R | G | B | R | G | B | R | G | B | R | G | B | R | G | B | R | G | B | R | G | B | R | G | B |
| 1 | | 7 | 0 | 12 | -6 | -1 | 0 | 4 | 4 | 3 | 5 | 6 | 1 | -2 | -4 | 6 | 6 | -5 | -1 | -1 | -1 | -8 | 2 | -6 | 6 |
| 2 | | 2 | -4 | 12 | 8 | -2 | 1 | -8 | -5 | 12 | 5 | -3 | -3 | 4 | 4 | 3 | -1 | -3 | 11 | -8 | 6 | -7 | 2 | 5 | -7 |
| 3 | | -1 | -5 | -3 | -5 | 3 | -10 | 7 | -4 | -7 | 1 | -1 | 11 | -2 | -1 | -12 | 5 | -1 | 4 | -7 | 4 | -8 | 6 | -5 | 9 |
| 4 | | 0 | 4 | -4 | -5 | -5 | -4 | 6 | 6 | -2 | 8 | 6 | 12 | -8 | 2 | 1 | -4 | 4 | -11 | -8 | 0 | 5 | -6 | -1 | -3 |
| 5 | | 4 | 0 | -5 | -4 | -5 | -11 | -7 | -5 | 8 | -2 | 5 | 4 | 1 | -2 | 10 | -1 | 4 | -6 | -1 | 1 | -10 | 0 | -5 | -7 |
| 6 | | 3 | 5 | 8 | -4 | 3 | 1 | 4 | 0 | 4 | -2 | -2 | 4 | -1 | 5 | -4 | 3 | 1 | -2 | 4 | 0 | 5 | -8 | 3 | -6 |
| 7 | | -4 | -1 | -2 | 6 | -3 | 3 | 8 | 3 | 6 | -4 | 5 | -12 | 8 | 3 | 8 | 5 | -1 | -6 | -5 | -1 | 5 | -3 | 1 | -10 |
| 8 | | 0 | 3 | 3 | -2 | -6 | 4 | -6 | 5 | 12 | -8 | -4 | 0 | 7 | -5 | -10 | -1 | -4 | 4 | 5 | -4 | -9 | -1 | 4 | -8 |

SPATIAL DIFFUSION TABLE 31

| VERTICAL PIXEL | HORIZONTAL PIXEL | 1 | | | 2 | | | 3 | | | 4 | | | 5 | | | 6 | | | 7 | | | 8 | | |
|---|---|---|---|---|---|---|---|---|---|---|---|---|---|---|---|---|---|---|---|---|---|---|---|---|---|
| | COLOR | R | G | B | R | G | B | R | G | B | R | G | B | R | G | B | R | G | B | R | G | B | R | G | B |
| 1 | | 3 | 3 | -6 | -4 | 6 | 5 | 8 | -4 | 11 | -6 | 6 | 9 | -1 | 3 | 6 | -7 | -6 | 2 | -8 | -4 | 1 | -2 | -6 | 5 |
| 2 | | 3 | 4 | -9 | 3 | 6 | 7 | 3 | 5 | 6 | -8 | -3 | 1 | 5 | 1 | 2 | 6 | 0 | 9 | -3 | -1 | 6 | -1 | -6 | -3 |
| 3 | | 1 | -5 | -12 | -3 | 3 | -2 | 6 | -2 | 6 | 4 | 0 | -4 | 1 | 4 | 1 | -8 | 1 | -3 | -8 | 2 | 7 | -1 | -6 | -6 |
| 4 | | -1 | -5 | -8 | -2 | 2 | -5 | 8 | -2 | 0 | -7 | -4 | 4 | -3 | -5 | 1 | 7 | 5 | -1 | 6 | 6 | 1 | 3 | 6 | -1 |
| 5 | | -6 | 0 | -9 | -4 | -6 | 3 | 8 | 6 | 0 | 4 | -4 | -6 | 8 | 5 | -10 | -2 | -2 | 10 | 2 | 1 | 8 | 0 | -4 | -2 |
| 6 | | -1 | 2 | 0 | -1 | -5 | -2 | -7 | -5 | -5 | -2 | -5 | 12 | -7 | -4 | 8 | -7 | -3 | -6 | 8 | -1 | -7 | 0 | 3 | -10 |
| 7 | | -7 | 1 | 4 | 6 | 3 | 8 | 5 | -4 | -1 | -3 | -4 | 8 | 4 | 6 | -2 | -2 | 1 | -11 | 2 | 6 | -10 | 8 | -4 | 9 |
| 8 | | 6 | -6 | -5 | 4 | 4 | -5 | -3 | 2 | -9 | -4 | 6 | 9 | -5 | -1 | -1 | -2 | 6 | -4 | 4 | -1 | -2 | 0 | 3 | -2 |

SPATIAL DIFFUSION TABLE 32

| VERTICAL PIXEL | HORIZONTAL PIXEL | 1 | | | 2 | | | 3 | | | 4 | | | 5 | | | 6 | | | 7 | | | 8 | | |
|---|---|---|---|---|---|---|---|---|---|---|---|---|---|---|---|---|---|---|---|---|---|---|---|---|---|
| | COLOR | R | G | B | R | G | B | R | G | B | R | G | B | R | G | B | R | G | B | R | G | B | R | G | B |
| 1 | | -4 | 6 | 0 | -6 | 5 | -3 | -5 | -4 | -6 | 0 | -5 | 0 | -2 | 3 | 5 | -4 | -5 | 9 | -2 | 2 | -9 | 6 | -5 | -10 |
| 2 | | 6 | 5 | 11 | -7 | 0 | -9 | 7 | -4 | 12 | -2 | -3 | -12 | 7 | -2 | 8 | 1 | -2 | 8 | -1 | -1 | 8 | -4 | 1 | 8 |
| 3 | | -3 | -2 | -6 | -6 | 6 | 11 | -1 | 2 | -2 | 0 | 2 | -10 | 7 | -4 | 6 | 0 | -6 | 0 | 1 | 1 | 1 | 5 | -3 | -12 |
| 4 | | 2 | 1 | -5 | -1 | 0 | 12 | 8 | -5 | 5 | -1 | -2 | 7 | -4 | -5 | 12 | -7 | -3 | -1 | 6 | -3 | 12 | -5 | 2 | -1 |
| 5 | | 1 | 6 | -1 | 7 | 4 | 0 | -7 | -1 | -6 | 0 | 6 | -11 | -6 | 6 | -8 | -5 | -6 | -1 | 4 | -3 | 11 | -1 | 0 | -5 |
| 6 | | -1 | 1 | -9 | 1 | 4 | -3 | -6 | 1 | 1 | 5 | 1 | 9 | 2 | -6 | -8 | -1 | -2 | -11 | 4 | 5 | 3 | 1 | -2 | 5 |
| 7 | | 3 | -4 | -12 | -6 | -6 | -5 | 0 | -1 | 7 | -7 | 3 | 12 | 8 | -1 | -7 | 2 | -4 | 7 | 0 | 2 | -9 | 7 | -6 | 12 |
| 8 | | 6 | 6 | 11 | -4 | -2 | 5 | 1 | 5 | -9 | 3 | 3 | -5 | 0 | 6 | -9 | -2 | 5 | -2 | -8 | 6 | -12 | 8 | 2 | 1 |

SPATIAL DIFFUSION TABLE 33 (NO SPATIAL DIFFUSION)

| VERTICAL PIXEL | HORIZONTAL PIXEL | 1 | | | 2 | | | 3 | | | 4 | | | 5 | | | 6 | | | 7 | | | 8 | | |
|---|---|---|---|---|---|---|---|---|---|---|---|---|---|---|---|---|---|---|---|---|---|---|---|---|---|
| | COLOR | R | G | B | R | G | B | R | G | B | R | G | B | R | G | B | R | G | B | R | G | B | R | G | B |
| 1 | | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 2 | | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 3 | | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 4 | | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 5 | | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 6 | | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 7 | | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 8 | | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |

FIG. 20 (a)

DATA OF THE IMMEDIATELY PRECEDING FRAME

| VERTICAL PIXEL | HORIZONTAL PIXEL | 1 | | | 2 | | | 3 | | | 4 | | | 5 | | | 6 | | | 7 | | | 8 | | |
|---|---|---|---|---|---|---|---|---|---|---|---|---|---|---|---|---|---|---|---|---|---|---|---|---|---|
| | COLOR | R | G | B | R | G | B | R | G | B | R | G | B | R | G | B | R | G | B | R | G | B | R | G | B |
| 1 | | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 2 | | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 3 | | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 4 | | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 5 | | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 6 | | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 7 | | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |
| 8 | | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 | 0 |

FIG. 20 (b)

DATA OF THE CURRENT FRAME

| VERTICAL PIXEL | HORIZONTAL PIXEL | 1 | | | 2 | | | 3 | | | 4 | | | 5 | | | 6 | | | 7 | | | 8 | | |
|---|---|---|---|---|---|---|---|---|---|---|---|---|---|---|---|---|---|---|---|---|---|---|---|---|---|
| | COLOR | R | G | B | R | G | B | R | G | B | R | G | B | R | G | B | R | G | B | R | G | B | R | G | B |
| 1 | | 30 | 31 | 32 | 33 | 34 | 35 | 36 | 37 | 38 | 39 | 40 | 41 | 42 | 43 | 44 | 45 | 46 | 47 | 48 | 49 | 50 | 51 | 52 | 53 |
| 2 | | 32 | 33 | 34 | 35 | 36 | 37 | 38 | 39 | 40 | 41 | 42 | 43 | 44 | 45 | 46 | 47 | 48 | 49 | 50 | 51 | 52 | 53 | 54 | 55 |
| 3 | | 34 | 35 | 36 | 37 | 38 | 39 | 40 | 41 | 42 | 43 | 44 | 45 | 46 | 47 | 48 | 49 | 50 | 51 | 52 | 53 | 54 | 55 | 56 | 57 |
| 4 | | 36 | 37 | 38 | 39 | 40 | 41 | 42 | 43 | 44 | 45 | 46 | 47 | 48 | 49 | 50 | 51 | 52 | 53 | 54 | 55 | 56 | 57 | 58 | 59 |
| 5 | | 38 | 39 | 40 | 41 | 42 | 43 | 44 | 45 | 46 | 47 | 48 | 49 | 50 | 51 | 52 | 53 | 54 | 55 | 56 | 57 | 58 | 59 | 60 | 61 |
| 6 | | 40 | 41 | 42 | 43 | 44 | 45 | 46 | 47 | 48 | 49 | 50 | 51 | 52 | 53 | 54 | 55 | 56 | 57 | 58 | 59 | 60 | 61 | 62 | 63 |
| 7 | | 42 | 43 | 44 | 45 | 46 | 47 | 48 | 49 | 50 | 51 | 52 | 53 | 54 | 55 | 56 | 57 | 58 | 59 | 60 | 61 | 62 | 63 | 64 | 65 |
| 8 | | 44 | 45 | 46 | 47 | 48 | 49 | 50 | 51 | 52 | 53 | 54 | 55 | 56 | 57 | 58 | 59 | 60 | 61 | 62 | 63 | 64 | 65 | 66 | 67 |

FIG. 21

DATA OF THE CURRENT FRAME + SPATIAL DIFFUSION TABLE 1

| VERTICAL PIXEL | HORIZONTAL PIXEL | 1 | | | 2 | | | 3 | | | 4 | | | 5 | | | 6 | | | 7 | | | 8 | | |
|---|---|---|---|---|---|---|---|---|---|---|---|---|---|---|---|---|---|---|---|---|---|---|---|---|---|
| | COLOR | R | G | B | R | G | B | R | G | B | R | G | B | R | G | B | R | G | B | R | G | B | R | G | B |
| 1 | | 35 | 33 | 38 | 36 | 33 | 28 | 42 | 37 | 27 | 37 | 41 | 30 | 39 | 48 | 37 | 37 | 52 | 59 | 49 | 54 | 54 | 46 | 56 | 61 |
| 2 | | 39 | 29 | 32 | 41 | 36 | 34 | 43 | 35 | 28 | 38 | 40 | 46 | 49 | 41 | 36 | 40 | 50 | 47 | 55 | 49 | 44 | 61 | 59 | 57 |
| 3 | | 36 | 29 | 35 | 35 | 43 | 39 | 38 | 36 | 47 | 47 | 41 | 37 | 38 | 41 | 39 | 50 | 45 | 51 | 54 | 55 | 57 | 52 | 60 | 53 |
| 4 | | 39 | 42 | 43 | 41 | 44 | 41 | 47 | 41 | 44 | 37 | 51 | 54 | 56 | 55 | 50 | 55 | 47 | 42 | 61 | 56 | 50 | 62 | 55 | 55 |
| 5 | | 32 | 40 | 46 | 36 | 36 | 49 | 38 | 39 | 55 | 45 | 52 | 56 | 49 | 48 | 57 | 61 | 57 | 45 | 51 | 52 | 70 | 64 | 54 | 54 |
| 6 | | 35 | 44 | 44 | 39 | 41 | 36 | 47 | 49 | 52 | 43 | 52 | 44 | 44 | 47 | 64 | 57 | 53 | 67 | 54 | 54 | 71 | 56 | 57 | 53 |
| 7 | | 50 | 46 | 45 | 37 | 48 | 54 | 40 | 54 | 41 | 57 | 52 | 46 | 51 | 61 | 49 | 60 | 60 | 57 | 55 | 61 | 68 | 64 | 66 | 61 |
| 8 | | 51 | 49 | 44 | 54 | 47 | 51 | 45 | 47 | 61 | 45 | 51 | 66 | 52 | 63 | 58 | 57 | 54 | 69 | 69 | 69 | 66 | 67 | 67 | 74 |

DATA OF THE CURRENT FRAME + SPATIAL DIFFUSION TABLE 2

| VERTICAL PIXEL | HORIZONTAL PIXEL | 1 | | | 2 | | | 3 | | | 4 | | | 5 | | | 6 | | | 7 | | | 8 | | |
|---|---|---|---|---|---|---|---|---|---|---|---|---|---|---|---|---|---|---|---|---|---|---|---|---|---|
| | COLOR | R | G | B | R | G | B | R | G | B | R | G | B | R | G | B | R | G | B | R | G | B | R | G | B |
| 1 | | 37 | 27 | 39 | 30 | 35 | 43 | 41 | 33 | 28 | 32 | 42 | 29 | 36 | 48 | 43 | 46 | 50 | 42 | 44 | 51 | 49 | 44 | 50 | 58 |
| 2 | | 34 | 38 | 35 | 28 | 35 | 49 | 36 | 45 | 33 | 37 | 36 | 34 | 49 | 42 | 51 | 46 | 43 | 40 | 44 | 56 | 58 | 57 | 53 | 63 |
| 3 | | 36 | 34 | 25 | 31 | 37 | 39 | 45 | 37 | 45 | 40 | 50 | 57 | 48 | 45 | 54 | 51 | 50 | 42 | 59 | 57 | 51 | 47 | 59 | 46 |
| 4 | | 28 | 34 | 42 | 44 | 40 | 47 | 38 | 38 | 55 | 46 | 43 | 59 | 51 | 55 | 48 | 53 | 52 | 54 | 47 | 54 | 45 | 52 | 55 | 59 |
| 5 | | 42 | 36 | 32 | 37 | 36 | 40 | 47 | 44 | 49 | 44 | 47 | 58 | 47 | 54 | 46 | 59 | 50 | 56 | 50 | 55 | 62 | 56 | 61 | 72 |
| 6 | | 38 | 46 | 32 | 51 | 45 | 48 | 44 | 42 | 59 | 50 | 45 | 53 | 51 | 56 | 48 | 58 | 50 | 48 | 60 | 60 | 58 | 67 | 66 | 51 |
| 7 | | 40 | 43 | 43 | 50 | 41 | 45 | 43 | 48 | 55 | 55 | 55 | 50 | 53 | 55 | 45 | 61 | 64 | 64 | 59 | 63 | 53 | 59 | 59 | 63 |
| 8 | | 44 | 45 | 46 | 47 | 48 | 49 | 50 | 51 | 52 | 53 | 54 | 55 | 56 | 57 | 58 | 59 | 60 | 61 | 62 | 63 | 64 | 65 | 66 | 67 |

⋮ AND SO FORTH

FIG. 22

DATA OF THE IMMEDIATELY PRECEDING FRAME + SPATIAL DIFFUSION TABLE 1

| VERTICAL PIXEL | HORIZONTAL PIXEL | 1 | | | 2 | | | 3 | | | 4 | | | 5 | | | 6 | | | 7 | | | 8 | | |
|---|---|---|---|---|---|---|---|---|---|---|---|---|---|---|---|---|---|---|---|---|---|---|---|---|---|
| | COLOR | R | G | B | R | G | B | R | G | B | R | G | B | R | G | B | R | G | B | R | G | B | R | G | B |
| 1 | | 26 | 26.1 | 25.9 | 26 | 26.1 | 26.4 | 25.7 | 25.9 | 26.4 | 25.9 | 25.7 | 26.3 | 25.8 | 25.4 | 25.9 | 25.9 | 25.2 | 24.8 | 25.3 | 25.1 | 25.1 | 25.5 | 25 | 24.7 |
| 2 | | 25.8 | 26.3 | 26.2 | 25.7 | 26 | 26.1 | 25.6 | 26 | 26.4 | 25.9 | 25.8 | 25.5 | 25.3 | 25.7 | 26 | 25.8 | 25.3 | 25.4 | 25 | 25.3 | 25.6 | 24.7 | 24.8 | 24.9 |
| 3 | | 26 | 26.3 | 26 | 26 | 25.6 | 25.8 | 25.9 | 26 | 25.4 | 25.4 | 25.7 | 25.9 | 25.9 | 25.7 | 25.8 | 25.3 | 25.5 | 25.2 | 25.1 | 25 | 24.9 | 25.2 | 24.8 | 25.1 |
| 4 | | 25.8 | 25.7 | 25.6 | 25.7 | 25.6 | 25.7 | 25.4 | 25.7 | 25.6 | 25.9 | 25.2 | 25.1 | 25 | 25 | 25.3 | 25 | 25.4 | 25.7 | 24.7 | 25 | 25.3 | 24.7 | 25 | 25 |
| 5 | | 26.2 | 25.8 | 25.5 | 26 | 26 | 25.3 | 25.9 | 25.8 | 25 | 25.5 | 25.2 | 25 | 25.3 | 25.4 | 24.9 | 24.7 | 24.9 | 25.5 | 25.2 | 25.2 | 24.3 | 24.6 | 25.1 | 25.1 |
| 6 | | 26 | 25.6 | 25.6 | 25.8 | 25.7 | 26 | 25.4 | 25.3 | 25.2 | 25.6 | 25.2 | 25.6 | 25.6 | 25.4 | 24.6 | 24.9 | 25.1 | 24.4 | 25.1 | 25.1 | 24.2 | 25 | 24.9 | 25.1 |
| 7 | | 25.3 | 25.5 | 25.5 | 25.9 | 25.4 | 25.1 | 25.8 | 25.1 | 25.7 | 24.9 | 25.2 | 25.5 | 25.2 | 24.7 | 25.3 | 24.8 | 24.8 | 24.9 | 25 | 24.7 | 24.4 | 24.6 | 24.5 | 24.7 |
| 8 | | 25.2 | 25.3 | 25.6 | 25.1 | 25.4 | 25.2 | 25.5 | 25.4 | 24.7 | 25.5 | 25.2 | 24.5 | 25.2 | 24.6 | 24.9 | 24.9 | 25.1 | 24.3 | 24.3 | 24.3 | 24.5 | 24.4 | 24.4 | 24.1 |

DATA OF THE IMMEDIATELY PRECEDING FRAME + SPATIAL DIFFUSION TABLE 2

| VERTICAL PIXEL | HORIZONTAL PIXEL | 1 | | | 2 | | | 3 | | | 4 | | | 5 | | | 6 | | | 7 | | | 8 | | |
|---|---|---|---|---|---|---|---|---|---|---|---|---|---|---|---|---|---|---|---|---|---|---|---|---|---|
| | COLOR | R | G | B | R | G | B | R | G | B | R | G | B | R | G | B | R | G | B | R | G | B | R | G | B |
| 1 | | 25.9 | 26.4 | 25.8 | 26.3 | 26 | 25.6 | 25.7 | 26.1 | 26.4 | 26.2 | 25.7 | 26.3 | 26 | 25.4 | 25.6 | 25.5 | 25.3 | 25.7 | 25.6 | 25.2 | 25.3 | 25.6 | 25.3 | 24.9 |
| 2 | | 26.1 | 25.9 | 26 | 26.4 | 26 | 25.3 | 26 | 25.5 | 26.1 | 25.9 | 26 | 26.1 | 25.3 | 25.7 | 25.2 | 25.5 | 25.6 | 25.8 | 25.6 | 25 | 24.9 | 24.9 | 25.1 | 24.6 |
| 3 | | 26 | 26.1 | 26.5 | 26.2 | 25.9 | 25.8 | 25.5 | 25.9 | 25.5 | 25.8 | 25.3 | 24.9 | 25.4 | 25.5 | 25.1 | 25.2 | 25.3 | 25.7 | 24.8 | 24.9 | 25.2 | 25.4 | 24.8 | 25.5 |
| 4 | | 26.4 | 26.1 | 25.7 | 25.6 | 25.8 | 25.4 | 25.9 | 25.9 | 25 | 25.5 | 25.6 | 24.8 | 25.2 | 25 | 25.4 | 25.1 | 25.2 | 25.1 | 25.4 | 25.1 | 25.5 | 25.2 | 25 | 24.8 |
| 5 | | 25.7 | 26 | 26.2 | 25.9 | 26 | 25.8 | 25.4 | 25.6 | 25.3 | 25.6 | 25.4 | 24.9 | 25.4 | 25.1 | 25.5 | 24.8 | 25.3 | 25 | 25.3 | 25 | 24.7 | 25 | 24.7 | 24.2 |
| 6 | | 25.9 | 25.5 | 26.2 | 25.2 | 25.5 | 25.4 | 25.6 | 25.7 | 24.8 | 25.3 | 25.5 | 25.1 | 25.2 | 25 | 25.4 | 24.9 | 25.3 | 25.4 | 24.8 | 24.8 | 24.9 | 24.4 | 24.5 | 25.2 |
| 7 | | 25.8 | 25.6 | 25.6 | 25.3 | 25.7 | 25.5 | 25.6 | 25.4 | 25 | 25 | 25 | 25.3 | 25.1 | 25 | 25.5 | 24.7 | 24.6 | 24.6 | 24.8 | 24.6 | 25.1 | 24.8 | 24.8 | 24.6 |
| 8 | | 25.6 | 25.5 | 25.5 | 25.4 | 25.4 | 25.3 | 25.3 | 25.2 | 25.2 | 25.1 | 25.1 | 25 | 25 | 24.9 | 24.9 | 24.8 | 24.8 | 24.7 | 24.7 | 24.6 | 24.6 | 24.5 | 24.5 | 24.4 |

⋮ AND SO FORTH

LIQUID CRYSTAL DISPLAY DEVICE FOR IMPROVING A DISPLAY RESPONSE SPEED AND DRIVING METHOD FOR THE SAME

This Nonprovisional application claims priority under 35 U.S.C. § 119(a) on Patent Application No. 2003/317182 filed in Japan on Sep. 9, 2003, and No. 2004/199867 filed in Japan on Jul. 6, 2004, the entire contents of which are hereby incorporated by reference.

FIELD OF THE INVENTION

The present invention relates to a liquid crystal dislay device used for a monitor of a computer, a TV etc., and also relates to the driving method thereof. More specifically, the present invention relates to a method for improving a display response speed upon display of a moving picture.

BACKGROUND OF THE INVENTION

To increase the response speed of liquid crystal, a method called overshoot driving or overdrive driving has been used. Japanese Patent publication Tokukosho 63-25556/1988 (published on May 25, 1988) discloses an example of such a method.

The method realizes an increase of the response speed by providing extra change to a liquid crystal module that has been changed by the input data. The following more specifically explains this technique.

For example, now assumes a liquid crystal module capable of 256 gradations.

Then, also assume that a picture element of the liquid crystal is displayed as gradation 0, and then changes to gradation 64 in response to the next input signal. In this case, it may occur that the liquid crystal responses so slowly to application of a voltage corresponding to 64 gradation that the gradation level does not reach 64. Similarly, further assume that the picture element is supplied with a voltage corresponding to gradation 84 but the liquid crystal responses so slowly that the gradation level does not reach 80 but reaches only 64.

Under such a condition, the liquid crystal is controlled to be changed from 0 to 80, instead of controlling it to be changed 0 to 64, so that the gradation reaches 64 more quickly. This is the method called overshoot driving or overdrive driving, that has been used for liquid crystal TVs of various manufacturers since when the duration of the patent of the foregoing publication had run out.

However, the conventional liquid crystal display device has a problem as follows.

In recent years, a liquid crystal display device, that had conventionally been used as a display device for a computer, is more often used as a display device for displaying a moving picture. This application has become more common with the development of a liquid crystal display device for a TV, and improvement of performance of a computer that is now capable of displaying a moving picture.

However, a critical problem of a liquid crystal module in use for a display device of the moving picture is low response speed of a liquid crystal. Namely, displaying a moving picture by a liquid crystal display device with a low response speed causes image-lag, thereby decreasing display quality. The response speed of the liquid crystal display device is particularly slow in a change between a halftone to a halftone compared to a change in monochrome display. Therefore, the degradation of display quality becomes significant in a particular moving picture of live action.

SUMMARY OF THE INVENTION

An object of the present invention is to provide a liquid crystal display device that improves a response time, and the driving method thereof.

In order to achieve the foregoing object, a liquid crystal display device according to the present invention comprises: liquid crystal elements, each of which is provided on one of a plurality of divisional display areas, that are created by dividing a display area, so as to display the divisional display area; and a display driving section for displaying the liquid crystal elements with a weighted mean of luminance ratios of the liquid crystal elements so as to reduce a display response time of the display area to be shorter than a hypothetical display response time in a case where the display area is displayed with a single liquid crystal element.

Further, in order to achieve the foregoing object, a driving method of a liquid crystal display device according to the present invention comprises the step of: (a) dividing a display area into a plurality of divisional display area; and (b) displaying the liquid crystal elements with a weighted mean of luminance ratios of the liquid crystal elements so as to reduce a display response time of the display area to be shorter than a hypothetical display response time in a case where the display area is displayed with a single liquid crystal element.

More specifically, the display response time of a liquid crystal display device greatly varies depending on the combination of the luminance ratio at the beginning and the luminance ratio at the end.

In this view, the present invention uses a liquid crystal display device in which a display area is divided into a plurality of divisional display areas, each of which is displayed with a corresponding liquid crystal element by using an individual luminance ratio. In this arrangement, the luminance of each picture element is equivalent to a weighted mean of the respective luminances of the liquid crystal elements of the divisional picture elements. With this method, it is possible to avoid a combination causing a long response time, thereby reducing delay of response in a specific halftone.

In the present invention, a display driving section displays the liquid crystal elements with a weighted mean of luminance ratios of the liquid crystal elements so as to reduce a display response time of the display area to be shorter than a hypothetical display response time in a case where the display area is displayed with a single liquid crystal element.

In this way, the present invention provides a liquid crystal display device that improves a response time, and the driving method thereof.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 3 is a table showing a display response time taken for a change from a luminance ratio at the beginning to a luminance ratio at the end, in the foregoing liquid crystal display device.

FIG. 5 is a table showing a display response time per 0.1 luminance ratio, taken for a change from a luminance ratio at the beginning to a luminance ratio at the end in the case of each picture element is divided into two divisional picture elements.

FIG. 6 is a table as variation of the present embodiment, showing a display response time taken for a change from a luminance ratio at the beginning to a luminance ratio at the end in the foregoing liquid crystal display device.

FIG. 8 is a drawing showing a lookup table of gradation data achieving the shortest response time to display the next frame, with respect to the current frame.

FIG. 9(*b*) is a plan view illustrating a display area having liquid crystal elements of Red (R), Green (G), Blue (B), Yellow (Y), Magenta (M) and Cyan (CN).

FIG. 9(*c*) is a plan view illustrating a display area having liquid crystal elements of Red (R), Green (G), Blue (B), Yellow (Y) and Cyan (CN), and FIG. 9(*d*) is a plan view illustrating a display area having liquid crystal elements of Red (R), Green (G), Blue (B), Yellow (Y), White (W) and Cyan (CN).

FIG. 15(*a*) is a plan view illustrating a monochrome stripe pattern of low spatial frequency.

FIG. 15(*b*) is a plan view of an example showing gradation 96 and gradation 128 with a small difference in luminance and high spatial frequency.

FIG. 16 is a plan view illustrating a display area in which gradation is varied for each picture element in consideration of the spatial frequency.

FIG. 18 is an explanatory view showing the first through sixth spatial diffusion tables of the 32+1 types of 8×8 spatial diffusion tables.

FIG. 19 is an explanatory view showing the 27th through 33rd spatial diffusion tables of the 32+1 types of 8×8 spatial diffusion tables.

FIG. 20(*a*) is an explanatory view illustrating data of the immediately preceding frame of a matrix.

FIG. 20(*b*) is an explanatory view illustrating data of the current frame.

FIG. 21 is an explanatory view showing the first and second tables of the first through 33rd spatial diffusion tables values of which have been added/subtracted to/from the current frame data.

FIG. 22 is an explanatory view showing the first and second tables of response times RT (ms), that are calculated according to the values of the respective tables found in the fifth step, and the data of the immediately preceding frame.

DESCRIPTION OF THE EMBODIMENTS

First Embodiment

One embodiment of the present invention is described below with reference to FIGS. 1 through 6.

The present invention provides a liquid crystal display device in which a conventional picture element is divided into a plurality of divisional picture elements, that are displayed with respective luminances so as to increase the display response speed of the display area to be faster than a hypothetical display response speed before the picture element is divided. The following explains such a display device and the driving method thereof.

Figure 2:
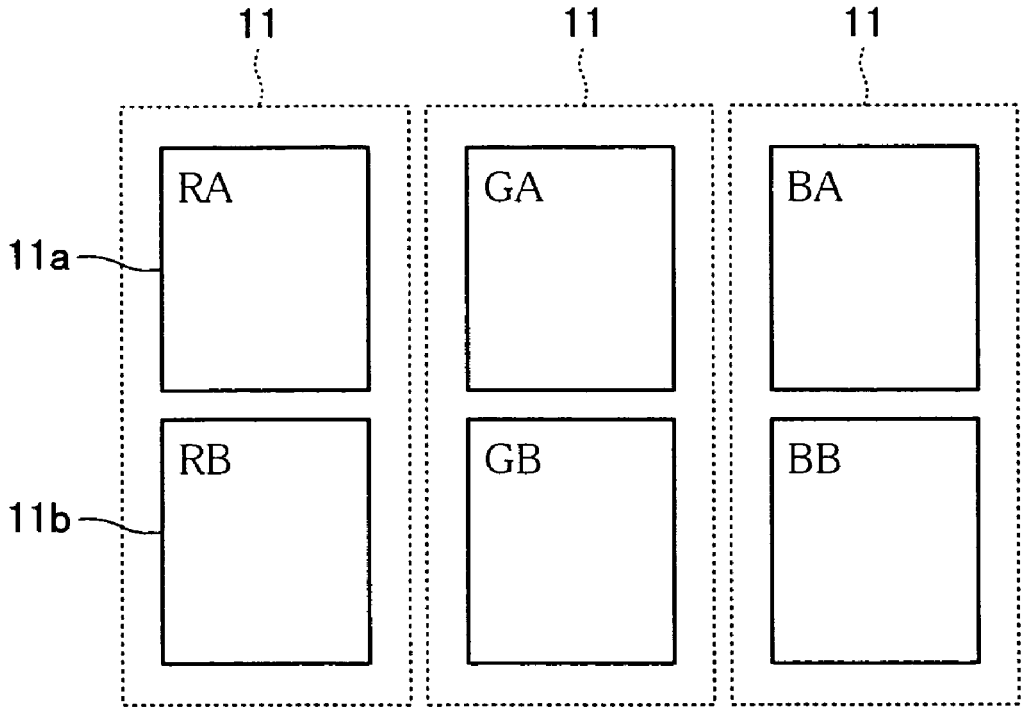
FIG. 2 is a plan view illustrating picture elements of the liquid crystal display device, that are divided into two divisional picture elements.

As shown in FIG. 2, the present embodiment uses picture elements 11 of Red (R), Green (G) and Blue (B), that are divided into, for example, two divisional picture elements RA/RB, GA/GB and BA/BB, respectively. The divisional picture elements RA/RB, GA/GB and BA/BB are individually driven by the respective liquid crystal elements 11*a* and 11*b*. Note that, the picture elements 11 correspond to conventional picture element areas of Red (R), Green (G) and Blue (B).

Figure 1:
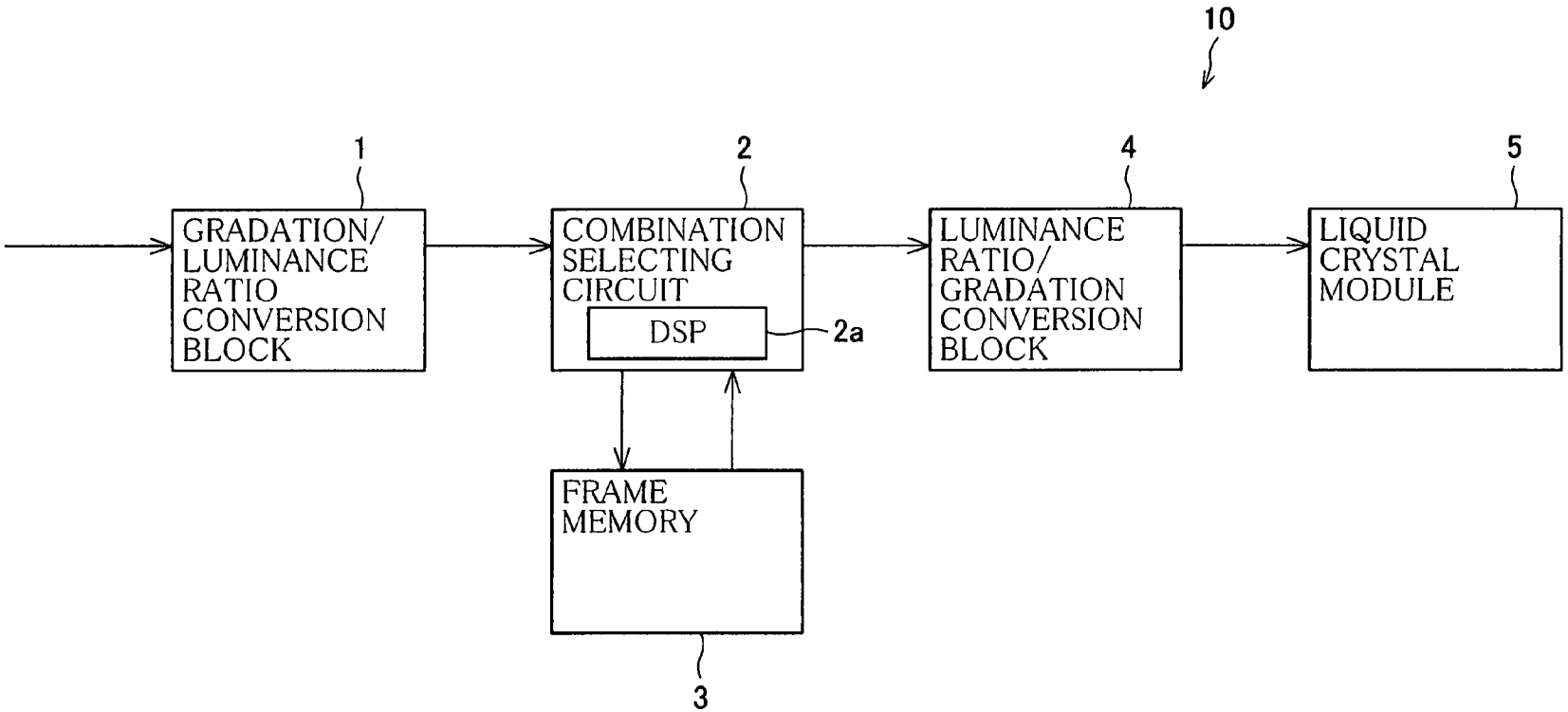
FIG. 1 is a block diagram illustrating a structure of a display driving section of a liquid crystal display device according to one embodiment of the present invention.

To drive such a picture element 11 made up of two liquid crystal elements 11*a* and 11*b*, a liquid crystal display device according to the present embodiment is provided with a display driving section 10 as display driving means, that includes, as shown in FIG. 1, a gradation/luminance ratio conversion block 1 functioning as gradation/luminance ratio converting means; a combination selecting circuit 2 functioning as selecting means; a frame memory 3 functioning as combination storing means, gradation/luminance ratio conversion result storing means and luminance ratio/gradation conversion result storing means; a luminance ratio/gradation conversion block 4 functioning as luminance ratio/gradation converting means; and a liquid crystal module 5.

The gradation/luminance ratio conversion block 1 converts a gradation data of an input signal into a luminance ratio. Note that, in the present embodiment, brightness of the display is expressed not as a luminance but as a luminance ratio. The luminance ratio is a ratio of a gradation value to the maximum gradation value. If assuming a case using a luminance, the luminance of the picture element 11 is equal to an arithmetic mean of the respective luminances of the liquid crystal elements 11*a* and 11*b*. Thus, the explanation will be more complicated.

Generally, in the case of ITU compliance, the value of a luminance ratio Ynorm with respect to a gradation n may be determined according to the following formula, where N denotes the maximum gradation.

$$Y\ norm=(n/N)^{2.2} \quad (1)$$

In the present embodiment, to perform addition of luminance, the input gradation data needs to be converted into a luminance ratio using the foregoing formula. The gradation/luminance ratio conversion block 1 performs this calculation.

Similarly, the luminance ratio/gradation conversion block 4 performs conversion from luminance ratio into gradation according to the gradation/luminance ratio characteristic of the liquid crystal module 5, that displays the luminance ratio data of the liquid crystal elements 11*a* and 11*b*, so as to again obtain the gradation data. Note that, the conversion function in this operation depends on the characteristic of the liquid crystal module 5. In the case of a liquid crystal module of ITU compliance, the function is an inverse function of that of the conversion block.

Meanwhile, the combination selecting circuit 2, provided between gradation/luminance ratio conversion block 1 and the luminance ratio/gradation conversion block 4, selects the respective luminance ratios of the divisional liquid crystal elements 11*a* and 11*b* through calculation based on the luminance ratio data outputted from the gradation/luminance ratio conversion block 1.

Here, the following describes a selection operation of the combination selecting circuit 2 in selecting the respective luminance ratios of the divisional liquid crystal elements 11*a* and 11*b*.

Firstly, a luminance ratio of a picture element inputted to a time point t is expressed as Ynorm, t. Further, the luminance ratios of the divisional liquid crystal elements 11*a* and 11*b* for displaying a single picture element 11 are expressed as Ynorm, t, A and Ynorm, t, B, respectively. Note that, these luminance ratios Ynorm, t, Ynorm, t, A and Ynorm, t, B are discrete values, each of which corresponds to a gradation value.

Here, the combination selecting circuit 2 includes a frame memory and stores information of the luminance ratios of the liquid crystal elements 11*a* and 11*b* in the immediately preceding frame. The information of the luminance ratios of the liquid crystal elements 11*a* and 11*b* in the immediately preceding frame are expressed as Ynorm, t−1, A and Ynorm, t−1, B, respectively.

First, the following describes a procedure of finding the luminance ratios Ynorm, t, A and Ynorm, t, B according to the luminance ratio Ynorm, t.

That is, the luminance ratio Ynorm, t, A is varied by a 0.005 pitch, and each value is then combined with the luminance ratio Ynorm, t, B to calculate the response time, so as to find the best response time. In other words, this calculation is performed to find a combination of the luminance ratios of the Ynorm, t, A and Ynorm, t, B to achieve the shortest response time.

The luminance ratio of a picture element 11 is equal to a weighted mean of the respective luminance ratios of the divisional liquid crystal elements 11*a* and 11*b*. Accordingly, the relation among the luminance ratios Ynorm, t, Ynorm, t, A and Ynorm, t, B may be expressed as follows.

$$\text{Y norm}, t=(\text{Y norm}, t, A+\text{Y norm}, t, B)\times 0.5 \quad (2)$$

According to the formula above, when the luminance ratios Ynorm, t and Ynorm, t, A are found, the luminance ratio Ynorm, t, B can also be found. However, since these values are discrete values, a value closest to the theoretical value is selected.

Next, the response time of the liquid crystal for display is expressed as a numeric value=a function f (x, y). FIG. 3 shows examples of each given values of the function f (x, y), where x corresponds to the luminance at the beginning and y corresponds to the luminance at the end.

Here, the following describes FIG. 3 in detail. FIG. 3 shows required response times for a change from 10% to 90%. In the figure, a vertical axis corresponds to the luminance ratio (the white luminance and the black luminance are normalized to 1.00 and 0.00, respectively) at the beginning and the horizontal axis corresponds to the luminance ratio at the end. The variation pitch of the luminance ratio is 0.05, for example. Note that, in the actual operation, the optimum pitch is 0.005 in terms of accuracy. Further, in the figure, the variation ranges from 10% to 90% instead of 0% to 100%. This is because a response time of a general liquid crystal is regulated with a range from 10% to 90%. In the case of VESA standard, it is measured from the signal input to 90% luminance.

Figure 4:
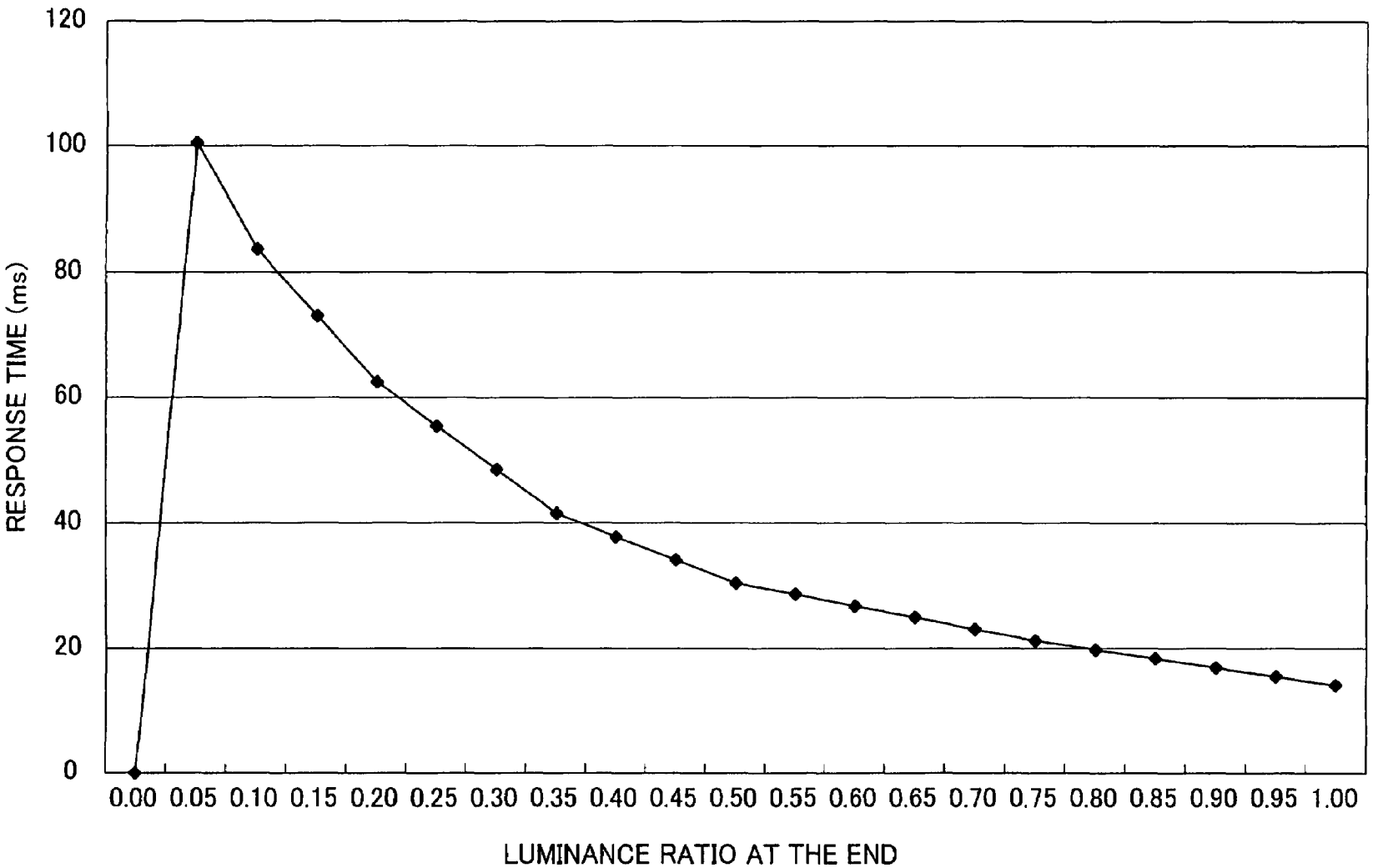
FIG. 4 is a graph showing a display response time taken for a change from a luminance ratio at the beginning=0 to the luminance ratio at the end in the example of FIG. 3.

FIG. 4 shows a graph in which the relation between the luminance ratio at the beginning=0.00 and the luminance ratio at the end=0.00–1.00 are plotted. This figure reveals that, when the luminance ratio at the beginning is 0.00, the response time RT becomes longer as the difference with respect to the luminance ratio at the end becomes smaller. More specifically, there exists an excessively slow response speed, that is, more than 100 ms. This is a characteristic of MVA or ASV type liquid crystal, and causes excessive slower response speed at a change of voltage application from 1V to 2-3V. This defective characteristic, that cannot be overcome even by the overshoot driving, can be solved by the driving method of the present embodiment. With this method, it is possible to screen out a combination causing a long response time, thereby reducing delay of response in a specific halftone.

As described, the luminance ratio of the immediately preceding frame is stored in the frame memory 3. Thus, based on the response time RT shown in FIG. 3, the response time RTA of the liquid crystal element 11*a* can be expressed as follows.

$$\text{RT}A=f((\text{Ynorm}, t-1, A), (\text{Ynorm}, t, A)) \quad (3)$$

Similarly, the luminance ratio Ynorm, t, B can be found by the foregoing formula (2), and therefore the response time RTB of the liquid crystal element 11*b* can be found by the following formula (4).

$$\text{RT}B=f((\text{Ynorm}, t-1, B), (\text{Ynorm}, t, B)) \quad (4)$$

The response time RT of the picture element 11 is the one with a longer time between the results of FIGS. (3) and (4).

In this way, the luminance ratio is calculated using each value of the Ynorm, t, A. Then, the luminance ratio of the Ynorm, t, A achieving the fastest response speed is selected.

If the luminance ratio Ynorm, t, A is found, the luminance ratio Ynorm, t, B can also be uniquely found according to Formula (2).

The result is then sent to the luminance ratio/gradation conversion block 4.

With the foregoing operation, the response speed can be increased.

Further, the luminance ratios Ynorm, t, A and Ynorm, t, B are found according to how much their luminance ratio values are changed in 1 frame after the immediately preceding frame, instead of using stationary luminance ratio values, thereby enabling combination with the overshoot driving.

The following described a specific example.

Currently, the response time RT taken for a change of the luminance ratio at the beginning=0.00 (black display) to the luminance ratio at the end=0.05 is 100.5 ms, as shown in FIG. 3. Accordingly, if the picture element is made of a single element, a change of the luminance ratio=0.00 to the luminance ratio=0.05 takes 100.5 ms. When the picture element includes two liquid crystal elements; for example, one of the luminance ratio is fixed to 0.00 while the other changes from 0.00 to 0.10. As shown in FIG. 3, the time taken for this change of the luminance ratio from 0.00 to 0.10 is 83.6 ms. That is, the response speed can be increased by approximately 17%.

In this way, the response speed can be increased in proportion to the number of liquid crystal elements included in the picture element.

The foregoing explanation can be expressed with the foregoing Formulas (3) and (4) as: RT=f ((Ynorm, 0.00), (Ynorm, 0.05))=100.5 ms. Namely, the response time RT taken to display a picture element 11 on a certain condition was 100.5 ms in a conventional structure. On the other hand, in the present embodiment, the picture element 11 is split into, for example, two divisional areas, that are individually driven by the liquid crystal elements 11*a* and 11*b*.

In the foregoing manner, the liquid crystal element 11*a* is driven with a luminance ratio at the beginning=0.00 (black display) and a luminance ratio at the end=0.00. In this case, the response time can be expressed as follows, according to Formula (3) and FIG. 3.

$$RTA=f((Ynorm, 0.00, A), (Ynorm, 0.00, A))=0 \text{ ms}$$

Meanwhile, the liquid crystal element 11*b* is driven with a luminance ratio at the beginning=0.00 (black display) and a luminance ratio at the end=0.10. In this case, the response time can be expressed as follows, according to Formula (4) and FIG. 3.

$$RTB=f((Ynorm, 0.00, B), (Ynorm, 0.10, B))=83.6 \text{ ms}$$

Further, the weighted mean of the respective luminance ratios of the liquid crystal element 11*a* and the liquid crystal element 11*b* can be expressed according to Formula (2) as: Ynorm, t=(Ynorm, 0.00, A+Ynorm, 0.10, B)×0.5=0.05. This value is equal to the luminance ratio of 0.05 at the end of a single picture element 11. Therefore, by displaying the liquid crystal elements 11*a* and 11*b* in the foregoing driving method, the display driving time will be 83.6 ms, this is faster than the time 100.5 taken to drive a single picture element 11.

The foregoing example however refers to only one combination of the liquid crystal elements 11*a* and 11*b*; therefore other combination may enable further increase of the response time RT.

Then, in the present embodiment, a combination achieving the shortest response time RTA is selected, referring to a look-up table shown in FIG. 5, for example.

The look-up table T1 shows the response time RT for each of combinations of the liquid crystal elements 11*a* and 11*b* varying with a 0.1 pitch.

In the look-up table T1, a vertical axis corresponds to luminance ratios of the liquid crystal elements 11*a* and 11*b* in the immediately preceding frame, while the horizontal axis corresponds to the luminance ratio of input data of the current frame. The values in the table denote the luminance ratios supposed to be given to the liquid crystal elements 11*a* and 11*b* in the current frame. In this table T1 divided into two parts, the upper half corresponds to the liquid crystal elements 11*a*, and the lower half corresponds to the liquid crystal elements 11*b*. Further, the luminance ratios of the liquid crystal elements 11*a* and 11*b* in the immediately preceding frame, that are shown in the vertical axis, include each pair of a luminance ratio=0 of the liquid crystal elements 11*a* with respect to luminance ratios of the liquid crystal elements 11*b*=0, 0.1, 0.2, . . . , 0.9, 1.0, and each pair of a luminance ratio=0.1 of the liquid crystal elements 11*a* with respect to luminance ratios of the liquid crystal elements 11*b*=0, 0.1, 0.2, . . . , 0.9, 1.0; in this manner, each pair up to luminance ratio=1.0 of the liquid crystal elements 11*a* with respect to luminance ratios of the liquid crystal elements 11*b*=0, 0.1, 0.2, . . . , 0.9, 1.0 is shown in the table.

According to the look-up table T1, for example, in the case where the luminance ratios of the liquid crystal elements 11*a* and 11*b* in the immediately preceding frame are "0.1" and "0.5", respectively, and the luminance ratio of input data of the current frame is "0.7; the luminance ratios of the liquid crystal elements 11*a* and 11*b* are preferably "0.934" and "0.466", respectively, in the current frame.

As described, in the liquid crystal display device of the present embodiment, a picture element 11 of Red (R) as 1 display area is divided into, for example, two divisional picture elements RA/RB. The divisional picture elements RA/RB are displayed based on the respective luminance ratios of the liquid crystal elements 11*a* and 11*b*.

In this case, the luminance ratio of the picture element 11 of Red (R) is equal to the weighted mean of the respective luminance ratios of the liquid crystal elements 11*a* and 11*b*. Therefore, by carrying out display of the liquid crystal elements 11*a* and 11*b* with luminance ratios that are selected by screening out a combination of the luminance ratio at the beginning and the luminance ratio at the end that causes a long response time, it is possible to reduce delay of response in a specific halftone.

In the present embodiment, the display driving section 10 causes the liquid crystal elements 11*a* and 11*b* to carry out display so that a display response time of the picture element 11 of, for example, Red (R), when using a weighted mean of luminance ratios of the liquid crystal elements 11*a* and 11*b* is shorter than a hypothetical display response time when assuming that the picture element 11 is displayed with a single liquid crystal element.

On this account, it is possible to provide a liquid crystal display device and the driving method thereof that achieve an increase of response time.

Further, the liquid crystal display device according to the present embodiment is arranged so that: the combination selecting circuit 2 of the display driving section 10 selects a combination offering a shortest response time among a plurality of combinations of the luminance ratios of the liquid crystal elements 11*a* and 11*b* that can reduce a display response time of, for example, the picture element 11 of Red (R) to be shorter than a hypothetical display response time that is obtained when the picture element 11 of Red (R) is displayed with a single liquid crystal element.

This structure allows display with the fastest display response time.

Further, the liquid crystal display device according to the present embodiment is arranged so that: the frame memory 3 of the display driving section 10 stores a table of various combinations of the luminance ratios of the liquid crystal elements 11*a* and 11*b* that can reduce a display response time of, for example, the picture element 11 of Red (R) to be shorter than a hypothetical display response time that is obtained when the picture element 11 of Red (R) is displayed with a single liquid crystal element.

This structure allows easy selection of various combinations achieving a short response time.

Further, the liquid crystal display device of the present embodiment is provided with the display driving section 10 including the gradation/luminance ratio conversion block 1 for converting gradation data into a luminance ratio, thereby allowing high-speed display of gradation data.

Further, in the liquid crystal display device of the present embodiment, the display driving section 10 includes a gradation/luminance ratio conversion block 1 for converting gradation data into a luminance ratio; and a luminance ratio/gradation conversion block 4 for converting the respective luminance ratios of the liquid crystal elements 11*a* and 11*b* achieving the shortest display response time, that is selected by the combination selecting circuit 2, into gradation data.

On this account, the gradation data can be displayed with the maximum response speed.

Further, the liquid crystal display device of the present embodiment uses a driving method in which, for example, the picture elements 11 of Red (R) is divided into two divisional picture elements by halving the area of the picture element 11 of Red (R).On this account, the divisional area may be created by a simplest manner, and therefore the process can be easily done while ensuring a relatively significant effect, thereby increasing so-called cost-effectiveness.

Further, to more easily realize the structure of the present embodiment, an alternative may be a method of blocking a luminance ratio at the end including a response time range greater than 50 ms, with reference to FIG. 3. This arrangement is shown in FIG. 6. In this way, it is no longer necessary to refer to the preceding frame data while avoiding a decrease of the response time. Thus, the frame memory can be omitted, thereby reducing cost.

As shown in FIG. 6, an increase of cell thickness causes a great decrease of yield; however, the response speed is increased. The foregoing method is particularly effective for such a case.

Note that, the combination selecting circuit 2 of the present invention is not particularly limited to the DSP (Digital Signal Processor) 2 used in the foregoing embodiment. For example, the selecting circuit 2 may be made of an analog circuit or any other circuit. Further, though the foregoing embodiment adopts the structure with a system outside the liquid crystal module, the system may also be mounted to the liquid crystal module or may be directly mounted to the liquid crystal panel.

Second Embodiment

Another embodiment of the present invention is described below. Note that, any structure other than those described in the following explanation is identical to that of Embodiment 1. Therefore, for ease of explanation, materials having the equivalent functions as those shown in the drawings pertaining to Embodiment 1 above will be given the same reference symbols, and explanation thereof will be omitted here.

In addition to the structure of the liquid crystal display device of Embodiment 1, the liquid crystal display device of the present embodiment additionally uses the following algorithm in the selection process of the luminance ratios Ynorm, t, A and Ynorm, t, B, that is described in Embodiment 1.

(1) The calculation result of response time RT is checked weather or not the value is shorter than the duration of 1 frame (2) If there are a plurality of results less than the duration of 1 frame, a result with the smallest difference between the luminance ratios Ynorm, t, A and Ynorm, t, B is selected Here, the duration of 1 frame has a frequency of 60 Hz and a length of 16.7 ms for NTSC, or a frequency of 50 Hz and a length of 20 ms for PAL or SECAM.

With this arrangement with the smallest difference between the luminance ratios Ynorm, t, A and Ynorm, t, B, coarseness of still picture can be reduced. More specifically, the amplitude of the spatial frequency component is reduced for each sub-pixel to a certain extent so that it cannot be easily recognized by human's visual sense characteristic. The spatial frequency will be described in detail in Embodiment 6.

In this way, in the liquid crystal display device of the present embodiment, the DSP2*a* functioning as judging means of the combination selecting circuit 2 checks, upon selection process of the luminance ratios of the liquid crystal elements 11*a* and 11*b*, weather or not the display response time for the combination is shorter than the duration of 1 frame.

Therefore, the response times longer than the duration of 1 frame are screened out in this process so as to select a combination realizing the shortest display response time. In this manner, the structure can achieve the effect of increasing the response speed.

Meanwhile, if the response time is shorter than the duration of 1 frame, the reduction of the response time is not necessary, and therefore, the selection is made to find a combination ensuring a good display quality among the combinations with the display response time shorter than 1 frame.

This selection in terms of both display quality and response time becomes more important when the response speed of the liquid crystal display device is successfully increased. For example, the reduction of cell thickness shown in FIG. 3 increases the response speed, as shown in FIG. 6. In this case, the selection of the combination may be performed with a wider range. Thus, by selecting the optimum one from the range, it is possible to realize a liquid crystal display device with a superior display quality and speedy response.

Further, if there are a plurality of combinations of the liquid crystal elements 11*a* and 11*b* making a response time less than the duration of 1 frame, the combination selecting circuit 2 selects a combination with the smallest difference in display response time between the liquid crystal elements 11*a* and 11*b*, with calculation operation by the DSP2*a*.

On this account, difference in luminance ratio between the liquid crystal elements 11*a* and 11*b* is reduced to a certain extent in the case of a still picture, so that it cannot be easily recognized by human's visual sense characteristic, thereby preventing degradation of display quality.

Third Embodiment

Figure 7:
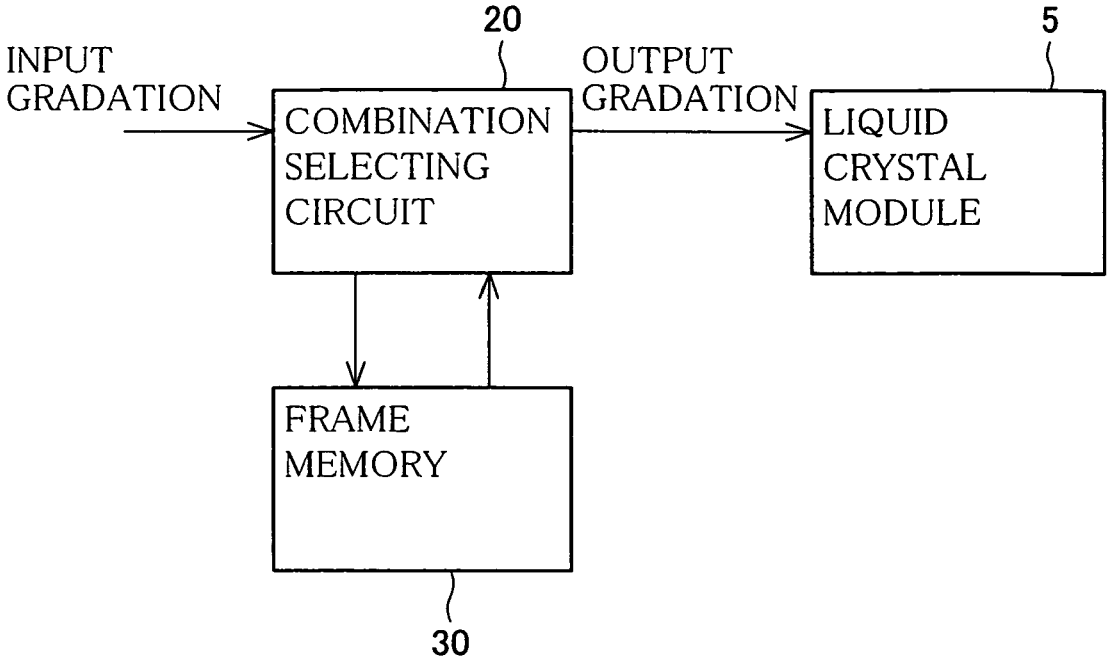
FIG. 7 is a block diagram according to another embodiment of the present invention, illustrating a structure of a display driving section of a liquid crystal display device that drives a liquid crystal module with a combination selecting circuit and a frame memory.

Still another embodiment of the present invention is described below with reference to FIGS. 7 and 8. The structure described in the present embodiment does not include the gradation/luminance ratio conversion block 1 and the luminance ratio/gradation conversion block 4, and instead includes a combination selecting circuit 20, that selects gradation data from a gradation data table stored in the frame memory 30 (gradation data storing means), as shown in FIG. 7.

More specifically, in the present embodiment, the frame memory 30 of the combination selecting circuit 20 stores gradation data of the liquid crystal elements 11*a* and 11*b*. However, since the table has data of the third power of color depth (input of the current frame, gradation of the immediately preceding frame of the liquid crystal element 11*a*, and gradation of the immediately preceding frame of the liquid crystal element 11*b*), the values are perceptibly large as shown in FIG. 8.

In the look-up table T2, a vertical axis corresponds to gradations of the liquid crystal elements 11*a* and 11*b* in the immediately preceding frame, while the horizontal axis corresponds to gradations of input data of the current frame. The values in the table denote gradations supposed to be given to the liquid crystal elements 11*a* and 11*b* in the current frame. In this table T2 divided into two parts, the upper half corresponds to the liquid crystal elements 11*a*, and the lower half corresponds to the liquid crystal elements 11*b*. Further, the gradations of the liquid crystal elements 11*a* and 11*b* in the immediately preceding frame, that are shown in the vertical axis, include each pair of gradation=0 of the liquid crystal elements 11*a* with respect to gradation of the liquid crystal elements 11*b*=0, 17, 34, . . . , 238, 255, up to gradation=255 of the liquid crystal elements 11*a* with respect to the luminance ratio of the liquid crystal elements 11*b* =0, 17, 34, . . . , 238, 255.

According to the look-up table T2, for example, in the case where the gradations of the liquid crystal elements 11*a* and 11*b* in the immediately preceding frame are "17" and "34", respectively, and the luminance ratio of input data of the current frame is "187; the gradations of the liquid crystal elements 11*a* and 11*b* are preferably "255" and "31", respectively, in the current frame.

As described, the liquid crystal display device of the present embodiment is provided with the frame memory 30 storing a table of display gradation data, that is converted from a combination of luminance ratios enabling the shortest display response time. The combination is previously selected by the combination selecting circuit 20 from the gradations of the liquid crystal elements 11*a* and 11*b*, i.e., input data of the current frame.

Therefore, since the frame memory 30 stores a table of the display gradation data, that is previously selected as a combination of luminance ratios and then converted into gradation data upon input of gradation of the current frame, the conversion operation from gradation to luminance ratio and the conversion operation from luminance ratio to gradation can be omitted, thereby increasing processing speed.

Further, the increase of response speed can be carried out with a compact structure using software.

Fourth Embodiment

Yet another embodiment of the present invention is described below with reference to FIGS. 9 through 13. Note that, any structure other than those described in the following explanation is identical to that of Embodiments 1 through 3. Therefore, for ease of explanation, materials having the equivalent functions as those shown in the drawings pertaining to Embodiments 1 through 3 above will be given the same reference symbols, and explanation thereof will be omitted here.

The foregoing Embodiments 1 through 3 uses the liquid crystal elements 11*a* and 11*b* created by halving a pixel 11.

Figure 9:
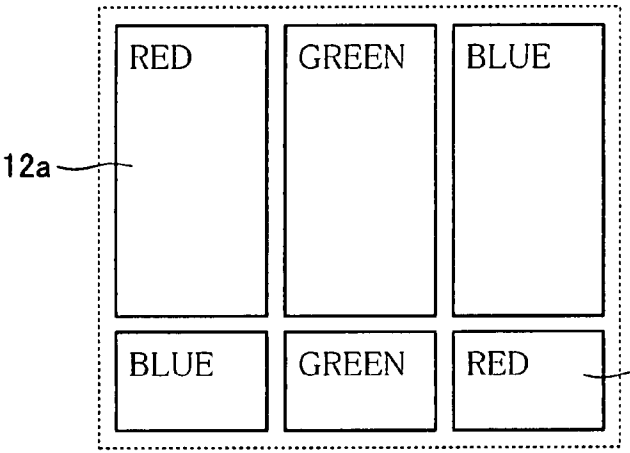
FIG. 9(*a*) is a plan view illustrating a display area made up of liquid crystal elements having different square measure units and picture elements arranged differently.
Figure 9:
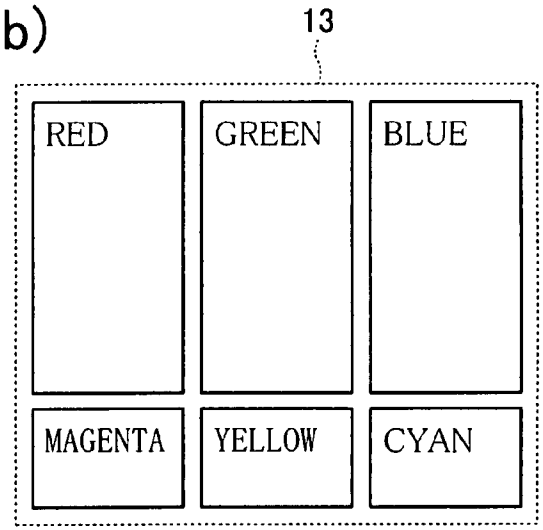
Figure 9:
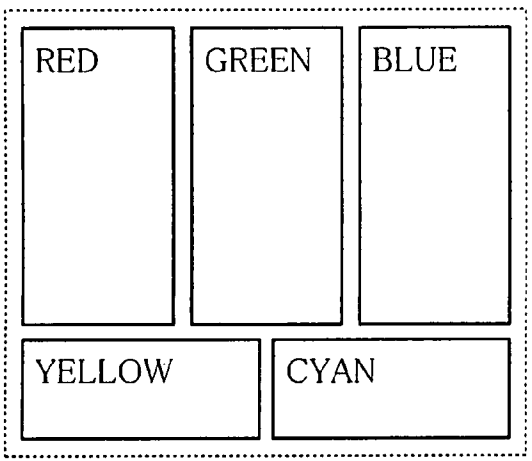
Figure 9:
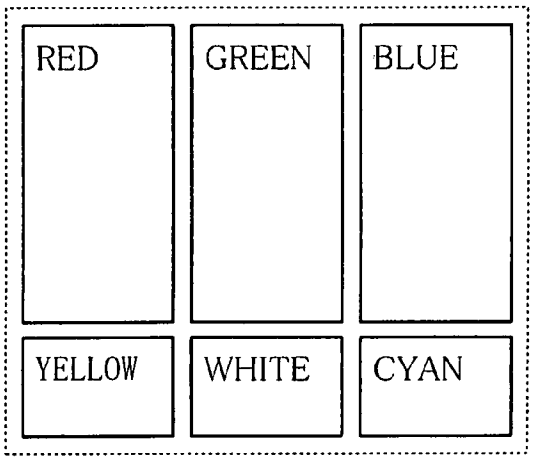

However, since the present invention requires a plurality of liquid crystal elements, a single picture element 11 is not necessarily has to be halved but may be made up of some elements having different square measure units or those arranged in a different manner, as shown in FIG. 9(*a*). More specifically, as shown in the figure, the picture element Red (R) may be made up of two liquid crystal elements 12*a* and 12*b* with an area ratio=3:1. Further, these liquid crystal elements 12*a* and 12*b* may be laid out either adjacently or with a distance.

Further, as shown in FIG. 9(*b*), it is not always required to make up the liquid crystal element of a pixel 13 with Red (R), Green (G) and Blue (B). For example, the liquid crystal element may be made up of Red (R), Green (G), Blue (B), Yellow (Y), Magenta (M) and Cyan (CN). Yellow (Y), Magenta (M) and Cyan (CN) pass through two colors among Red (R), Green (G) and Blue (B), thereby increasing luminance. However, since there are some difficulties in creation of a color filter of magenta (M), a structure without Magenta (M), that is shown in FIG. 9(*c*), is more practical.

Further, in terms of increase of luminance ratio, a structure additionally having a white (W) liquid crystal element is more preferable. Here, the white (W) liquid crystal element refers to one without a color filter, which ensures a luminance three times greater than the element having Red (R), Green (G) and Blue (B) filters. Such an element without a color filter has been used for a display device for a medical X-ray picture or the like that requires only a monochrome image.

Here, the following describes how to find the luminance ratio for each arrangement.

Figure 10:
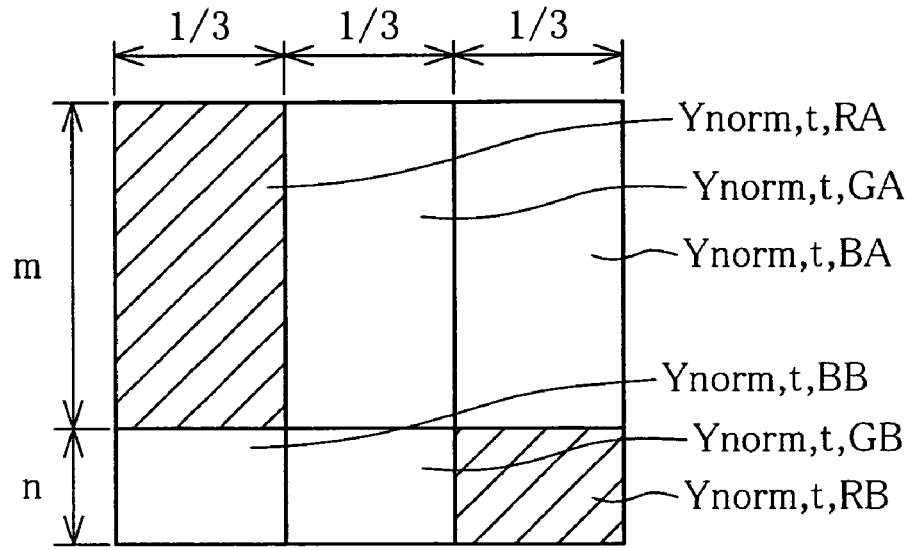
FIG. 10 is an explanatory view showing a calculation model for finding the respective display response times in the structure of 9(*a*).

In the arrangement of FIG. 9(*a*), the size of the divisional sub-pixel and the luminance ratio are defined as shown in FIG. 10. In FIG. 10, m+n=1. Note that, a general definition of pixel is a minimum area unit constituting an image. In a single pixel, the luminance level and the color are constant. Further, a pixel usually includes picture elements of Red (R), Green (G) and Blue (B), that are expressed as units called sub-pixels. In the present embodiment, the sub-pixel is divided into further smaller areas, each of which is called a divisional sub-pixel.

The respective luminances of Red (R), Green (G) and Blue (B) of the pixel may be expressed as follows, where the luminance of Red (R) is denoted by Ynorm, t, R, the luminance of Green (G) is denoted by Ynorm, t, G and the luminance of Blue (B) is denoted by Ynorm, t, B.

$$\text{Ynorm}, t, \text{R}=\text{Ynorm}, t, \text{R}A\times m+\text{Ynorm}, t, \text{R}B\times n$$

$$\text{Ynorm}, t, \text{G}=\text{Ynorm}, t, \text{G}A\times m+\text{Ynorm}, t, \text{G}B\times n$$

$$\text{Ynorm}, t, \text{B}=\text{Ynorm}, t, \text{B}A\times m+\text{Ynorm}, t, \text{B}B\times n$$

Figure 11:
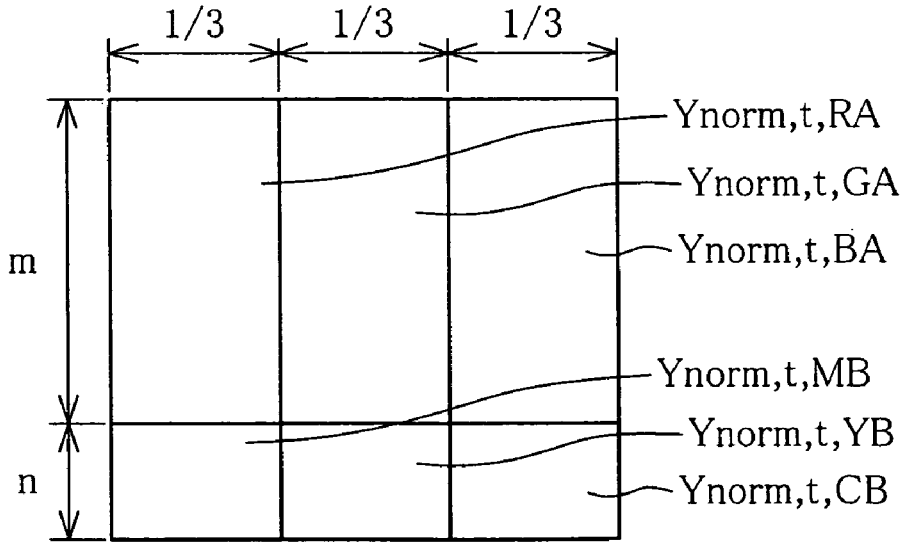
FIG. 11 is an explanatory view showing a calculation model for finding the respective display response times in the structure of 9(*b*).

Next, in the arrangement of FIG. 9(*b*), the size of the divisional sub-pixel and the luminance ratio are defined as shown in FIG. 11 on condition that m+n=1. Note that, in the present embodiment, each of the additional picture elements, if there are any, is also called a divisional sub-pixel.

In this arrangement, the respective luminances of Red (R), Green (G) and Blue (B) of the pixel may be expressed as follows, where the luminance of Red (R) is denoted by Ynorm, t, R, the luminance of Green (G) is denoted by Ynorm, t, G and the luminance of Blue (B) is denoted by Ynorm, t, B.

$$Ynorm, t, R=Ynorm, t, RA\times m+Ynorm, t, YB\times n+Ynorm, t, WB\times n$$

$$Ynorm, t, G=Ynorm, t, GA\times m+Ynorm, t, YB\times n+Ynorm, t, CB\times n+Ynorm, t, WB\times n$$

$$Ynorm, t, B=Ynorm, t, BA\times m+Ynorm, t, CB\times n+Ynorm, t, WB\times n$$

Figure 12:
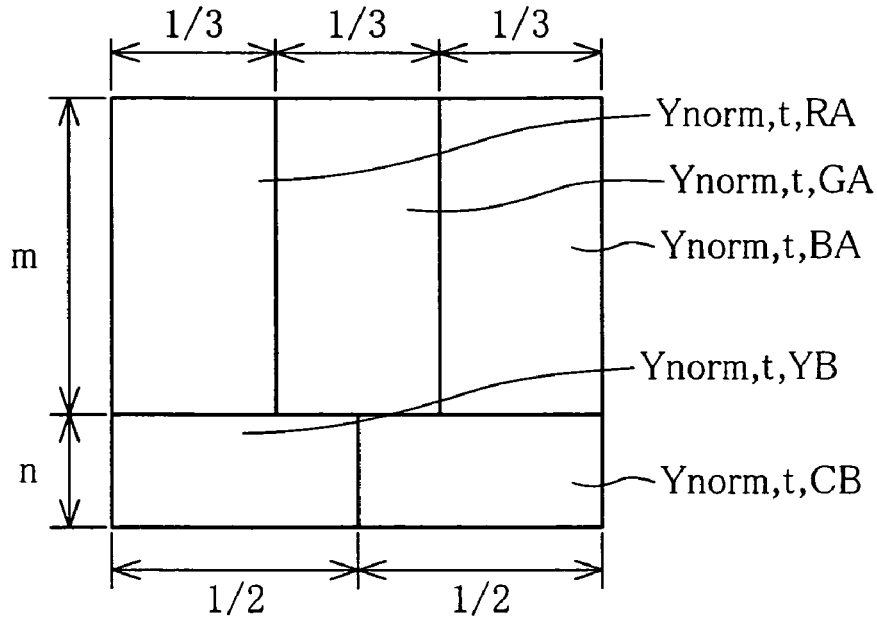
FIG. 12 is an explanatory view showing a calculation model for finding the respective display response times in the structure of 9(*c*).

Further, in the arrangement of FIG. 9(*c*), the size of the divisional sub-pixel and the luminance ratio are defined as shown in FIG. 12 on condition that m+n=1.

In this arrangement, the respective luminances of Red (R), Green (G) and Blue (B) of the pixel may be expressed as follows, where the luminance of Red (R) is denoted by Ynorm, t, R, the luminance of Green (G) is denoted by Ynorm, t, G and the luminance of Blue (B) is denoted by Ynorm, t, B.

$$Ynorm, t, R=Ynorm, t, RA\times m+Ynorm, t, YB\times 1.5n$$

$$Ynorm, t, G=Ynorm, t, GA\times m+Ynorm, t, YB\times 1.5n$$

$$+\text{Ynorm}, t, \text{CB}\times 1.5\text{n}$$

$$Ynorm, t, B=Ynorm, t, BA\times m+Ynorm, t, CB\times 1.5n$$

Figure 13:
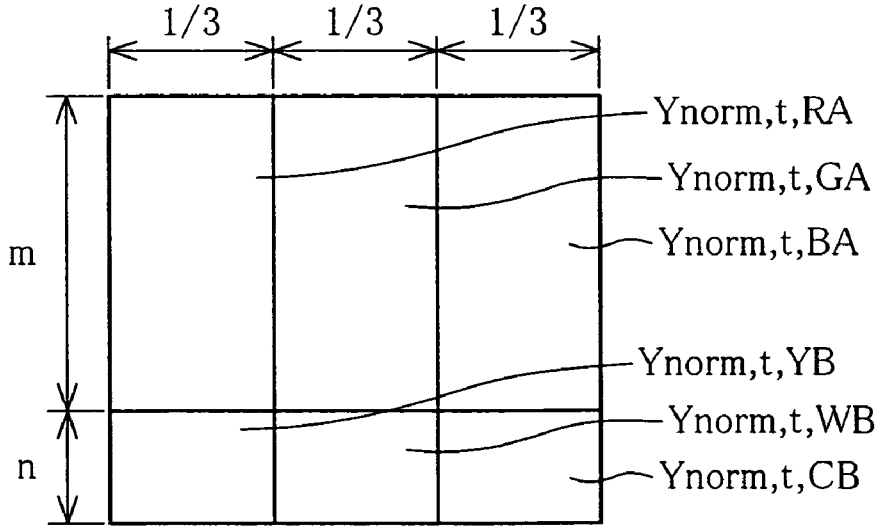
FIG. 13 is an explanatory view showing a calculation model for finding the respective display response times in the structure of 9(*d*).

Finally, in the arrangement of FIG. 9(*d*), the size of the divisional sub-pixel and the luminance ratio are defined as shown in FIG. 13 on condition that m+n=1.

In this arrangement, the respective luminances of Red (R), Green (G) and Blue (B) of the pixel may be expressed as follows, where the luminance of Red (R) is denoted by Ynorm, t, R, the luminance of Green (G) is denoted by Ynorm, t, G and the luminance of Blue (B) is denoted by Ynorm, t, B.

$$Ynorm, t, R = Ynorm, t, RA \times m + Ynorm, t, YB \times n + Ynorm, t, WB \times n$$

$$Ynorm, t, G = Ynorm, t, GA \times m + Ynorm, t, YB \times n + Ynorm, t, CB \times n + Ynorm, t, WB \times n$$

$$Ynorm, t, B = Ynorm, t, BA \times m + Ynorm, t, CB \times n + Ynorm, t, WB \times n$$

The display area is divided into three picture elements of Red (R), Green (G) and Blue (B), and each of the picture element is further divided into two divisional picture elements. Thus, the display area includes six divisional display areas.

Generally, a single pixel has picture elements of Red (R), Green (G) and Blue (B). In the foregoing arrangement, each picture element of Red (R), Green (G) and Blue (B) is further divided into smaller areas, thereby increasing the response speed for each picture element of Red (R), Green (G) and Blue (B) in one pixel.

Further, the driving method of a liquid crystal display device according to the present embodiment is arranged so that: a Blue (B) picture element is not adjacent to another Blue (B) picture element.

With this arrangement, it is possible to prevent degradation of display quality caused by a light-blocking portion of wiring, called a BM (Black Matrix), that exists between the respective sub-pixels and becomes visible as a thick dark line by visually connecting to the picture element of Blue (B) having low luminance.

Further, the driving method of a liquid crystal display device according to the present embodiment is arranged so that: when the display area is divided, the display area is divided into picture elements of Red (R), Green (G), Blue (B) and at least one other color. For example, the display area may be divided into picture elements of Red (R), Green (G), Blue (B), Yellow (Y), Magenta (M) and Cyan (CN).

With this arrangement, one pixel includes other picture elements than Red (R), Green (G) and Blue (B), thereby increasing the luminance of each of the picture elements Red (R), Green (G) and Blue (B). Therefore, the effect of increase in response time becomes more significant.

Further, the driving method of a liquid crystal display device according to the present embodiment may be arranged so that: when the display area is divided, the display area is divided into picture elements of Red (R), Green (G), Blue (B), Yellow (Y) and Cyan (CN).

Since this arrangement does not include a picture element of Magenta (M), it allows omission of the complex creation of color filter of Magenta (M), thereby forming the pixel in an easier way.

Further, the driving method of a liquid crystal display device according to the present invention may be arranged so that: the display area is divided into picture elements of Red (R), Green (G), Blue (B), Yellow (Y), White (W) and Cyan (CN).

With this arrangement of additionally including a white (W) picture element, the luminance ratio in a single pixel can be sufficiently increased.

Fifth Embodiment

Figure 14:
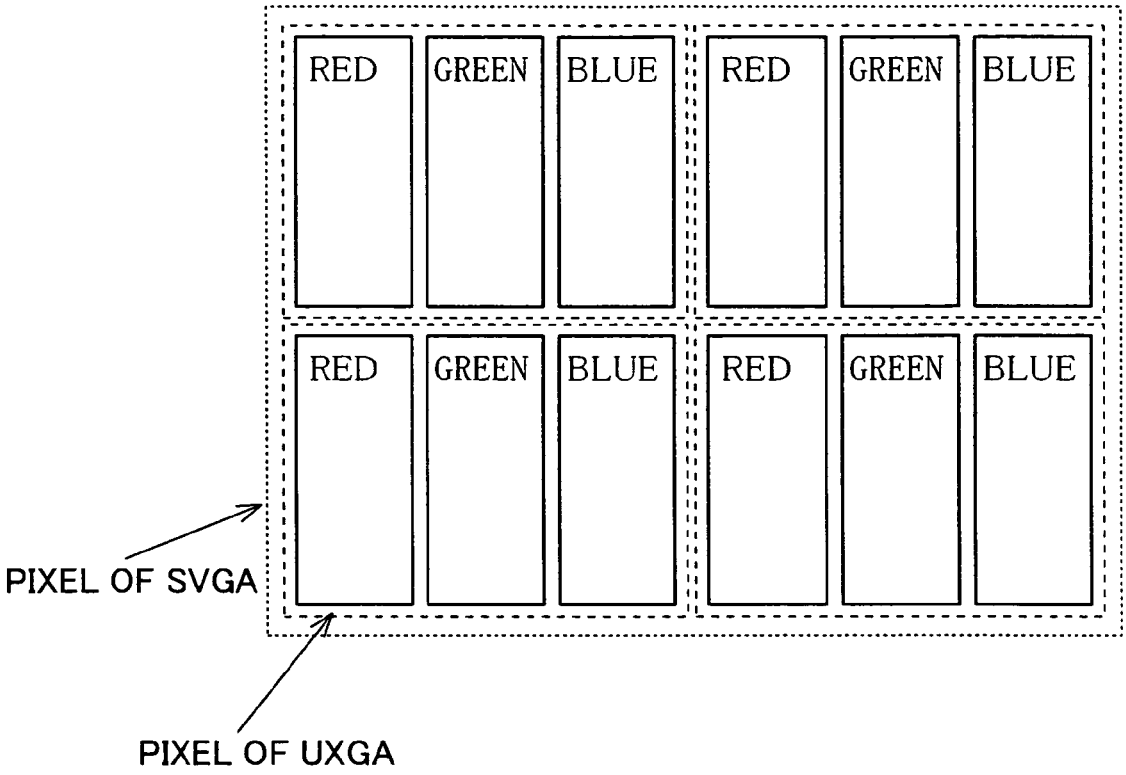
FIG. 14 is a plan view showing the relation between a UXGA module and a SVGA module, when a SVGA signal is displayed in the UXGA module.

Still another embodiment of the present invention is described below with reference to FIG. 14. Note that, any structure other than those described in the following explanation is identical to that of Embodiments 1 through 4. Therefore, for ease of explanation, materials having the equivalent functions as those shown in the drawings pertaining to Embodiments 1 through 4 above will be given the same reference symbols, and explanation thereof will be omitted here.

The present invention may have a similar structure when adopted for an arrangement in which a low-resolution signal is displayed by a high-definition module. For example, as shown in FIG. 14, when a SVGA signal is displayed by a UXGA module, four UXGA pixels exist in a single SVGA pixel. Accordingly, the response speed for the SVGA signal may be increased by selecting a combination for each of the four SVGA pixels.

Note that, UXGA has a resolution of 1600×1200 pixels. Further, SVGA has a resolution of 800×600 pixels.

The present embodiment describes a case where a SVGA input signal is projected to a UXGA liquid crystal display device through scaling.

A general TV signal, such as NTSC, PAL, SECAM is substantially equivalent to VGA (640×480), and therefore it may be more exact to explain scaling of the VGA input signal; however, since there is no standard for resolution of constant multiple of VGA, the present embodiment uses an example of UXGA and SVGA for ease of explanation.

This driving method is capable of carrying out display with suitable methods for both TVs and monitors. This is because the use for a TV often requires display of a moving picture even with low resolution, and therefore faster response time is more important, whereas resolution has priority in the use for a monitor. Also, a 3D simulator PC game requiring high-speed drawing performs high-definition drawing, and therefore requires a large computation ability, that results in low-resolution. In this case, the processes of the present embodiment may be used for the driver of the video card.

As described, the liquid crystal display device of the present embodiment uses a method in which, when a display area is divided into a plurality of smaller areas, and a SVGA pixel (with a resolution of 800×600 pixels) includes four UXGA pixels (with a resolution of 1600×1200 pixels), i.e., the SVGA pixel and the UXGA pixels are in a constant multiple relation, the four pixels have different luminances to one another so as to increase response speed in the case of low resolution. Note that., such as a pair of VGA (a resolution of 640×480 pixels) and QVGA (a resolution of 1280×960 pixels), or a pair of XGA (a resolution of 1024×768 pixels) and QXGA (a resolution of 2048×1536 pixels) has a similar relation.

Therefore, for example, to deal with the use for a TV that requires display of a moving picture even with low resolution and therefore faster response time is preferable, and the use for a computer monitor in which resolution has priority; the liquid crystal display device of the present embodiment is switched between those different uses. With this divisional displaying function, the display device can easily be switched to the TV mode when a TV video signal is inputted to a computer monitor, so that the TV video signal can be displayed with a high response speed.

Sixth Embodiment

Yet another embodiment of the present invention is described below with reference to FIGS. 15 through 22. Note that, any structure other than those described in the following explanation is identical to that of Embodiments 1 through 5. Therefore, for ease of explanation, materials having the equivalent functions as those shown in the drawings pertaining to Embodiments 1 through 5 above will be given the same reference symbols, and explanation thereof will be omitted here.

Since the liquid crystal display is used by a person, the present invention provides an effect that is realized by being combined with a visual angle characteristic of human.

The spatial resolving power of human being is limited to a certain level. Therefore, it allows recognition of a certain part but does not allow recognition of the other part depending on the spatial frequency and the degree of change in luminance. Therefore, these irresolvable parts cannot be recognized by human's eyes if there is no change in luminance within the range. Accordingly, the gradation may be shifted for each picture element within this range. Further, by performing the shifting in gradation in consideration of the response speed, it is possible to increase the response speed.

Due to the characteristic, the present embodiment is more easily adopted for a liquid crystal module with a finer definition.

Here, the spatial frequency refers to a result of Fourier transformation of the alignment of pixels. A high spatial frequency component denotes a tiny change component such as a pixel-to-pixel change, while a low spatial frequency component denotes a change involving many pixels. Further, the spatial frequency to human's eyes depends on the angle of eyesight.

More specifically, for example, when looking at lines drawn on a paper with a constant small pitch, it gradually changes to a gray plane rather than lines as the distance between our eyes and the paper becomes larger. This is because the increase of distance changes the spatial frequency, thus disabling human's eyes to recognize the change from White to Black. As a result, the lines look like a gray plane to the viewer. Similarly, eye recognition also hard in the case where change in luminance is small. For example, FIG. 15(*a*) shows a White and Black stripe pattern with a low spatial frequency, and FIG. 15(*b*) shows a case with a high spatial frequency but a small luminance difference between gradation 96 and gradation 128. With an increase of the distance between the eyes and the figures, the one in FIG. 15(*b*) first start looking more like a gray plane.

The following describes shifting of gradation for each picture element. In the present embodiment, for example, gradation is shifted for each picture element as shown in FIG. 16. In FIG. 16, the gradation is shifted within a range that the difference cannot be recognizable by human's eye. The gradation shifting is performed also in consideration of the response speed, within a range of causing no luminance change.

Specifically, as shown in FIG. 16, in the picture element of Red (R), the four pixels are varied in gradations by factors of +4, −2, +2 and −4, respectively. Accordingly, the sum T of these variations in gradation is expresses as: T=(+4)+(−2)+(+2)+(−4)=0. This indicates that the display area of Red (R) has no change in gradation, meaning that there is no change in luminance ratio. Further, for the area outside the recognition range of resolving power, human's eyes use recognition of the total number of luminous fluxes in the resolvable range. Therefore, if those areas have the same luminous flux value for the respective spectrums, they result in the same vision. Accordingly, it is necessary for these areas to have the same luminance ratio. However, since gradation and luminance value may be varied for each pixel, by creating different variation patterns and adopting one achieving the fastest response speed, the entire display speed can be increased.

In the same figure, the sum T is 0 also in Green (G) and Blue (B). Further, human's eyes detect change in gradation with the largest sensitivity to Green (G), and then Red (R), and then Blue (B); accordingly, Blue (B) has to have the largest gradation shifting amount, then Red (R), and Green (G).

The following explains a specific example.

Figure 17:
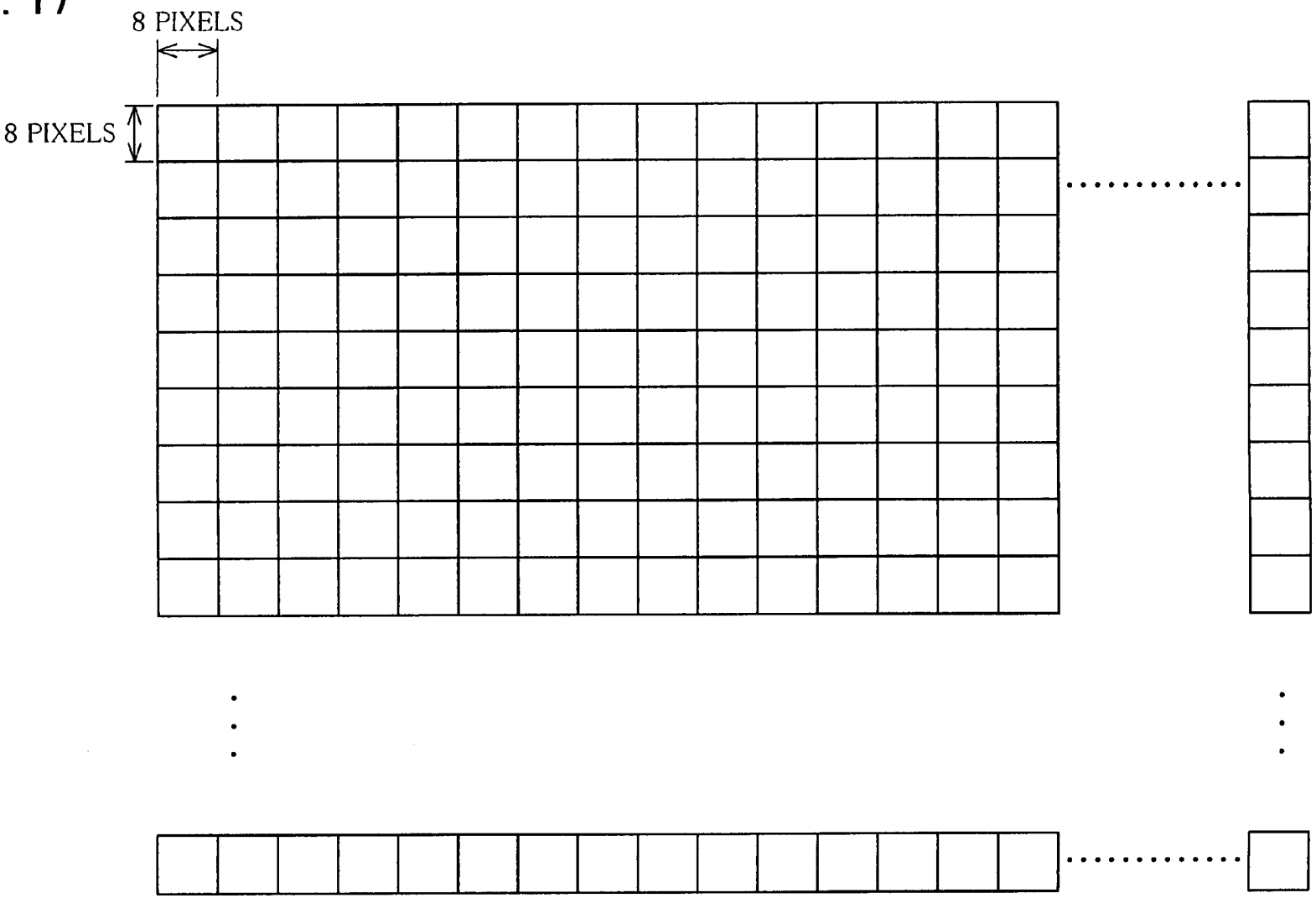
FIG. 17 is a plan view illustrating a data of 1 screen divided into 8×8 pixels square to use spatial diffusion.

In the first step, data of a screen is split into squares of 8×8 pixels as shown in FIG. 17. Then, in the second step, a plurality of spatial diffusion tables are prepared as 8×8 gradation variation tables, as shown in FIGS. 18 and 19. The values of these spatial diffusion tables to be added/subtracted to/from the data are determined so that the result of addition or subtraction will not be visually recognized by human's eyes.

The present embodiment uses 32+1 types of table. The +1 spatial diffusion table is not subjected to spatial diffusion. This table is useful in the case where a noise component is not required.

Next, in the third step, each piece of the 8×8 data split in the first step is processed. More specifically, as shown in FIGS. 20(*a*) and 20(*b*), data of the current frame and data of the immediately preceding frame are taken out from the matrix.

Next, in the fourth step, the data of the current frame and data of the immediately preceding frame are compared with each other. Further, if the maximum value of their difference is at or less than a certain gradation value, the data of the current frame is outputted without modification (followed by the ninth step below).

Namely, the fourth step is performed to judge whether the current image is a still image or a moving image. In the case of a still image, it is not necessary to increase the response speed, and therefore the rest of the procedures can be omitted. Further, an error at or less than certain gradation value is likely to analog noise or noise caused by I/P (Interlace progressive conversion) of TV, and therefore, an image with such a noise can be treated as a still image. Further, a still image may be displayed with superior appearance if the noise is not precisely reproduced.

Next, in the fifth step, the values of the spatial diffusion tables 1 through 33 are added/subtracted to/from the data of the current frame, as shown in FIG. 21.

Next, in the sixth step, the response time RT (ms) is found according to the values of the respective tables calculated in the fifth step, and the data of the immediately preceding frame, as shown in FIG. 22.

Next, in the seventh step, the optimum spatial diffusion table is decided according to the result of the sixth step. The criterion for this decision differs depending on the resolution. Specifically, when the resolution is coarse, the respective tables are compared with one another in terms of the data with the longest response time, and then the table having the shortest response time RT is selected. On the other hand, when the resolution is fine, the average of the values is found for each table, and the table having the fastest average of the response speed is selected.

Further, in the case of ITU standard, the proportion of the luminance component of Green (G) is large, accounting for approximately 60% in a single pixel. Therefore, the selection can be made only with the data of Green (G). However, it should be noted that there are some nonstandard modules such as an office-automation module in which the whiteness is more bluish (including a larger amount of the luminance component of Blue (B)) or a domestic module for a T corporation in which the whiteness is more reddish (including a larger amount of the luminance component of Red (R)). These nonstandard modules require some caution.

Next, in the eighth step, the data selected in the seventh step is outputted. Note that, this calculation has already been done in the fifth step.

Finally, in the ninth step, the data outputted in the eighth step is written into the frame memory 3.

As described, the driving method of a liquid crystal display device according to the present embodiment is arranged so that: when the display area is divided into a plurality of divisional areas, gradations of the divisional display areas are varied within a range that a difference cannot be recognizable by human's eye and the gradations are then converted into luminance ratios, so as to display the liquid crystal elements with a weighted mean of luminance ratios.

Therefore, the response speed can be increased by using a visual angle characteristic of human.

Further, the driving method of a liquid crystal display device according to the present embodiment is arranged so that: gradations of the divisional display areas are varied within a range that a difference cannot be recognizable by human's eye in accordance with a plurality types of gradation variation tables and one type of gradation variation table with no gradation variation.

In this arrangement, the +1 spatial diffusion table with no gradation variation is not subjected to increase or decrease in gradation. This table is useful in the case where the spatial diffusion is not required, since an input signal can be precisely outputted in the absence of spatial diffusion.

Further, the driving method of a liquid crystal display device according to the present embodiment is arranged so that: gradation of a current frame and gradation of an immediately preceding frame for a display area are compared with each other and, when a maximum value of a difference between the gradation of the current frame and the gradation of the immediately preceding frame among all liquid crystal elements is at or less than a certain gradation, the gradation of the current frame is outputted without modification.

With this arrangement, when a maximum value of a difference between the gradation of the current frame and the gradation of the immediately preceding frame among all liquid crystal elements is at or less than a certain gradation, it indicates that the difference in gradation occurs due to typical noise of analog signal or noise caused by I/P conversion. Therefore, since it can be seen that the difference is not caused by a moving picture, the process of the present embodiment can be omitted.

Further, the driving method of a liquid crystal display device according to the present embodiment is arranged so that: gradation of a current frame is added to each of gradations of the gradation variation tables, and resulting values are converted into luminance ratios to figure out display response times so as to create display response time tables.

In this arrangement, plural types of display response time tables are created, and one of these tables has to be selected.

Then, in the present embodiment, in a case of coarse resolution, the display response time tables are compared with each other in terms of a longest response time so as to carry out display using a display response time table offering a shortest response time.

More specifically, the longest response time in each display response time response table is time taken for display in the pattern. Accordingly, in a case of coarse resolution, the display response time tables are compared with each other in terms of a longest response time, so as to select a display response time table offering a shortest response time.

On the other hand, in a case of fine resolution, the display response time tables are compared with each other in terms of an average display response time so as to carry out display using a display response time table offering a shortest response time.

More specifically, each display area has a small square measure size in a case of fine resolution, and therefore, by selecting a display response time table having the shortest average display response time, the whole display area can be displayed with the shortest response time.

In this manner, the selection factor changes depending on whether the resolution is coarse or fine, thereby more practically increasing the response speed.

Further, the driving method of a liquid crystal display device according to the present embodiment may be arranged so that: according to the setting of whiteness (chroma at the point where the all sub-pixels are lit at the maximum luminance) when a pixel contains 50% or greater Green (G) luminance component, comparison of the longest response time or the average response time is performed only with respect to gradation of Green (G).

In this manner, the response speed is determined with reference to data of Green (G) whose luminance component is large and significant, thereby achieving the effect more easily.

As described, the liquid crystal display device according to the present invention is arranged so that: the display driving means includes selecting means for selecting a combination offering a shortest response time among a plurality of combinations of the luminance ratios of the liquid crystal elements reducing a display response time of the display area to be shorter than a hypothetical display response time that is obtained when the display area is displayed with a single liquid crystal element.

With this invention, the selecting means of the display driving means selects a combination offering a shortest response time among a plurality of combinations of the luminance ratios of the liquid crystal elements reducing a display response time of the display area to be shorter than a hypothetical display response time that is obtained when the display area is displayed with a single liquid crystal element.

Therefore, the display can be carried out with the shortest display response time.

Further, the liquid crystal display device according to the present invention is arranged so that: the display driving means includes combination storing means for storing a table of various combinations of the luminance ratios of the liquid crystal elements reducing a display response time of the display area to be shorter than a hypothetical display response time that is obtained when the display area is displayed with a single liquid crystal element.

With this invention, the combination storing means of the display driving means stores a table of various combinations of the luminance ratios of the liquid crystal elements reducing a display response time of the display area to be shorter than a hypothetical display response time that is obtained when the display area is displayed with a single liquid crystal element.

Therefore, it is possible to easily select a required combination offering the fast display response time from the table.

Further, the liquid crystal display device according to the present invention is arranged so that: the display driving means includes gradation/luminance ratio converting means for converting gradation to a luminance ratio.

With this invention, the display driving means includes gradation/luminance ratio converting means for converting gradation to a luminance ratio, thereby displaying gradation data with high-speed.

Further, the liquid crystal display device according to the present invention is arranged so that: the display driving means includes gradation/luminance ratio converting means for converting gradation to a luminance ratio; and luminance ratio/gradation converting means for converting the combination of the luminance ratios of the liquid crystal elements offering a shortest response time, that is selected by the selecting means, into gradation.

Therefore, it is possible to display the gradation data with the fastest response speed.

Further, the liquid crystal display device according to the present invention is arranged so that: the display driving means includes gradation data storing means that stores a table of display gradation data, that has been selected as the combination of luminance ratios and has been converted into gradation, with respect to gradation of a current frame that is input data inputted to each liquid crystal display element.

With this invention, since the frame memory stores a table of the display gradation data, that is previously selected as a combination of luminance ratios and then converted into gradation data upon input of gradation of the current frame, the conversion operation from gradation to luminance ratio and the conversion operation from luminance ratio to gradation can be omitted, thereby increasing processing speed.

Further, the liquid crystal display device according to the present invention further comprising: judging means for judging, when selecting the combination of the luminance ratios of the liquid crystal elements offering the shortest response time, weather or not the display response time given by the combination is shorter than a duration of 1 frame.

With this invention, the judging means of the selecting means judges, when selecting the combination of the luminance ratios of the liquid crystal elements offering the shortest response time, weather or not the display response time given by the combination is shorter than a duration of 1 frame.

Therefore, the response times longer than the duration of 1 frame are screened out in this process so as to select a combination realizing the shortest display response time. In this manner, the structure can achieve the effect of increasing the response speed.

Meanwhile, if the response time is shorter than the duration of 1 frame, the reduction of the response time is not necessary, and therefore, the selection is made to find a combination ensuring a good display quality among the combinations with the display response time shorter than 1 frame.

Further, the liquid crystal display device according to the present invention is arranged so that: the selecting means selects a combination with a smallest difference between the luminance ratios of the liquid crystal elements, when there are a plurality of combinations of luminance ratios of the liquid crystal elements offering a response time shorter than the duration of 1 frame.

With this invention, difference in luminance ratio between the liquid crystal elements 11*a* and 11*b* is reduced to a certain extent in the case of a still picture, so that it cannot be easily recognized by human's visual sense characteristic, thereby preventing degradation of display quality.

Further, a driving method of a liquid crystal display device according to the present invention is arranged so that: when the display area is divided, the display area is halved into two areas.

With this method, the divisional area may be created by a simplest manner, and therefore the process can be easily done while ensuring a relatively significant effect, thereby increasing so-called cost-effectiveness.

Further, the driving method of a liquid crystal display device according to the present invention is arranged so that: when the display area is divided, the display area is divided into three picture elements of Red (R), Green (G) and Blue (B), and each of the picture element is further divided into two divisional picture elements.

With this invention, the display area is divided into three picture elements of Red (R), Green (G) and Blue (B), and each of the picture element is further divided into two divisional picture elements. Thus, the display area includes six divisional display areas.

Generally, a single pixel has picture elements of Red (R), Green (G) and Blue (B). In the foregoing arrangement, each picture element of Red (R), Green (G) and Blue (B) is further divided into smaller areas, thereby increasing the response speed for each picture element of Red (R), Green (G) and Blue (B) in one pixel.

Further, the driving method of a liquid crystal display device according to the present invention is arranged so that: a Blue (B) picture element is not adjacent to another Blue (B) picture element.

With this arrangement, it is possible to prevent degradation of display quality caused by a light-blocking portion of wiring, called a BM (Black Matrix), that exists between the respective sub-pixels and becomes visible as a thick dark line by visually joining to the picture element of Blue (B) having low luminance.

Further, the driving method of a liquid crystal display device according to the present invention is arranged so that: when the display area is divided, the display area is divided into picture elements of Red (R), Green (G), Blue (B) and at least one other color.

Further, the driving method of a liquid crystal display device according to the present invention is arranged so that: when the display area is divided, the display area is divided into picture elements of Red (R), Green (G), Blue (B), Yellow (Y), Magenta (M) and Cyan (CN).

With this arrangement, one pixel includes other picture elements than Red (R), Green (G) and Blue (B), thereby increasing the luminance of each of the picture elements Red (R), Green (G) and Blue (B). Therefore, the effect of increase in response time becomes more significant.

Further, the driving method of a liquid crystal display device according to the present invention is arranged so that: when the display area is divided, the display area is divided into picture elements of Red (R), Green (G), Blue (B), Yellow (Y) and Cyan (CN).

Since this arrangement does not include a picture element of Magenta (M), it allows omission of the complex creation of color filter of Magenta (M), thereby forming the pixel in an easier way.

Further, the driving method of a liquid crystal display device according to the present invention is arranged so that: the display area is divided into picture elements of Red (R), Green (G), Blue (B), Yellow (Y), White (W) and Cyan (CN).

With this arrangement of additionally including a white (W) picture element, the luminance ratio in a single pixel can be sufficiently increased.

Further, the driving method of a liquid crystal display device according to the present invention is arranged so that: when the display area is divided, 1 pixel data of a SVGA module is divided by constant multiple, such as into four pixels of a UXGA module. Note that, such as a pair of VGA (a resolution of 640×480 pixels) and QVGA (a resolution of 1280×960 pixels), or a pair of XGA (a resolution of 1024×768 pixels) and QXGA (a resolution of 2048×1536 pixels) has a similar relation.

With this invention, the liquid crystal display device of the present embodiment uses a method in which, for example, when a SVGA pixel (with a resolution of 800×600 pixels) includes four UXGA pixels (with a resolution of 1600×1200 pixels), i.e., the SVGA pixel and the UXGA pixels are in a constant multiple relation, the four pixels have different luminances to one another so as to increase response speed in the case of low resolution.

Therefore, for example, to deal with the use for a TV that requires display of a moving picture even with low resolution and therefore faster response time is preferable, and the use for a computer monitor in which resolution has priority; the liquid crystal display device of the present embodiment is switched between those different uses. With this divisional displaying function, the display device can easily be switched to the TV mode when a TV video signal is inputted to a computer monitor, so that the TV video signal can be displayed with a high response speed.

Further, the driving method of a liquid crystal display device according to the present invention is arranged so that: when the display area is divided, gradations of the divisional display areas are varied within a range that a difference cannot be recognizable by human's eye and the gradations are then converted into luminance ratios, so as to display the liquid crystal elements with a weighted mean of the luminance ratios.

With this invention, when the display area is divided, gradations of the divisional display areas are varied within a range that a difference cannot be recognizable by human's eye (this effect is called spatial diffusion) and the gradations are then converted into luminance ratios, so as to display the liquid crystal elements with a weighted mean of the luminance ratios.

Therefore, the response speed can be increased by using a visual angle characteristic of human.

Further, the driving method of a liquid crystal display device according to the present invention is arranged so that: gradations of the divisional display areas are varied within a range that a difference cannot be recognizable by human's eye in accordance with a plurality types of gradation variation tables and one type of gradation variation table with no gradation variation.

With this invention, gradations of the divisional display areas are varied within a range that a difference cannot be recognizable by human's eye in accordance with a plurality types of gradation variation tables and one type of gradation variation table with no gradation variation.

In this arrangement, the +1 spatial diffusion table with no gradation variation is not subjected to increase or decrease in gradation. This table is useful in the case where the spatial diffusion is not required, since an input signal can be precisely outputted in the absence of spatial diffusion.

Further, the driving method of a liquid crystal display device according to the present invention is arranged so that: gradation of a current frame and gradation of an immediately preceding frame for a display area are compared with each other and, when a maximum value of a difference between the gradation of the current frame and the gradation of the immediately preceding frame among all liquid crystal elements is at or less than a certain gradation, the gradation of the current frame is outputted without modification.

With this arrangement, when a maximum value of a difference between the gradation of the current frame and the gradation of the immediately preceding frame among all liquid crystal elements is at or less than a certain gradation, it indicates that the difference in gradation occurs due to typical noise of analog signal or noise caused by I/P conversion. Therefore, since it can be seen that the difference is not caused by a moving picture, the process of the present embodiment can be omitted.

Further, the driving method of a liquid crystal display device according to the present invention is arranged so that: gradation of a current frame is added to each of gradations of the gradation variation tables, and resulting values are converted into luminance ratios to figure out display response times so as to create display response time tables, and in a case of coarse resolution, the display response time tables are compared with each other in terms of a longest response time so as to carry out display using a display response time table offering a shortest response time, and in a case of fine resolution, the display response time tables are compared with each other in terms of an average display response time so as to carry out display using a display response time table offering a shortest response time.

With this invention, gradation of a current frame is added to each of gradations of the gradation variation tables, and resulting values are converted into luminance ratios to figure out display response times so as to create display response time tables.

In this arrangement, plural types of display response time tables are created, and one of these tables has to be selected.

Then, in the present invention, in a case of coarse resolution, the display response time tables are compared with each other in terms of a longest response time so as to carry out display using a display response time table offering a shortest response time.

More specifically, the longest response time in each display response time response table is time taken for display in the pattern. Accordingly, in a case of coarse resolution, the display response time tables are compared with each other in terms of a longest response time, so as to select a display response time table offering a shortest response time.

On the other hand, in a case of fine resolution, the display response time tables are compared with each other in terms of an average display response time so as to carry out display using a display response time table offering a shortest response time.

More specifically, each display area has a small square measure size in a case of fine resolution, and therefore, by selecting a display response time table having the shortest average display response time, the whole display area can be displayed with the shortest response time.

In this manner, the selection factor changes depending on whether the resolution is coarse or fine, thereby more practically increasing the response speed.

Further, the driving method of a liquid crystal display device according to the present invention is arranged so that: when a pixel contains a Green (G) luminance component in a proportion of 50% or greater, comparison of the longest response time or the average response time is performed only with respect to gradation of Green (G) in selecting a display response time table offering a shortest response time.

In other words, the driving method of a liquid crystal display device according to the present embodiment may be arranged so that: according to the setting of whiteness (chroma at the point where the all sub-pixels are lit at the maximum luminance) when a pixel contains 50% or greater Green (G) luminance component, comparison of the longest response time or the average response time is performed only with respect to gradation of Green (G).

In this manner, the response speed is determined with reference to data of Green (G) whose luminance component is large and significant, thereby achieving the effect more easily.

For example, for a general ITU standard, a pixel contains the luminance component of (G) at a proportion of approximately 60%. Accordingly, with the foregoing arrangement, the response speed may be easily increased for a standard module.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A liquid crystal display device, comprising:

liquid crystal elements, each of which is provided on one of a plurality of divisional display areas, that are created by dividing a display area, so as to display the divisional display area;

display driving means for displaying the liquid crystal elements with a weighted mean of luminance ratios of the liquid crystal elements based on a combination offering a shortest response time selected among a plurality of combinations of the luminance ratios of the liquid crystal elements, so as to reduce a display response time of the display area to be shorter than a hypothetical display response time that is obtained when the display area is displayed with a single liquid crystal element; and judging means for judging, when selecting the combination of the luminance ratios of the liquid crystal elements offering the shortest response time, whether or not the display response time given by the combination is shorter than a duration of 1 frame.

2. The liquid crystal display device as set forth in claim 1, wherein:

the display driving means includes combination storing means for storing a table of various combinations of the luminance ratios of the liquid crystal elements reducing a display response time of the display area to be shorter than a hypothetical display response time that is obtained when the display area is displayed with a single liquid crystal element.

3. The liquid crystal display device as set forth in claim 1, wherein:

the display driving means includes gradation/luminance ratio converting means for converting gradation to a luminance ratio.

4. The liquid crystal display device as set forth in claim 1, wherein:

the display driving means includes gradation/luminance ratio converting means for converting gradation to a luminance ratio; and luminance ratio/gradation converting means for converting the combination of the luminance ratios of the liquid crystal elements offering a shortest response time, that is selected by the selecting means, into gradation.

5. The liquid crystal display device as set forth in claim 1, wherein:

the display driving means includes gradation data storing means that stores a table of display gradation data, that has been selected as the combination of luminance ratios and has been converted into gradation, with respect to gradation of a current frame that is input data inputted to each liquid crystal display element.

6. The liquid crystal display device as set forth in claim 1, wherein selecting the combination offering the shortest response time includes:

selecting the combination with a smallest difference between the luminance ratios of the liquid crystal elements, when there are a plurality of combinations of luminance ratios of the liquid crystal elements offering a response time shorter than the duration of 1 frame.

7. A driving method of a liquid crystal display device, comprising the step of:

(a) dividing a display area into a plurality of divisional display areas, each divisional display area comprising a liquid crystal element, wherein gradations of the divisional display areas are varied within a range that a difference cannot be recognizable by human's eye with a plurality types of gradation variation tables and one type of gradation variation table with no gradation, and the gradations are then converted into luminance ratios, so as to display the liquid crystal elements with a weighted mean of the luminance ratios; and (b) displaying the liquid crystal elements with the weighted mean of luminance ratios of the liquid crystal elements based on a combination offering a shortest response time selected among a plurality of combinations of the luminance ratios of the liquid crystal elements, so as to reduce a display response time of the display area to be shorter than a hypothetical display response time that is obtained when the display area is displayed with a single liquid crystal element.

8. The driving method of a liquid crystal display device as set forth in claim 7, wherein: in the step (a), the display area is halved into two areas.

9. The driving method of a liquid crystal display device as set forth in claim 7, wherein:

in the step (a), the display area is divided into three picture elements of Red (R), Green (G) and Blue (B), and each of the picture element is further divided into two divisional picture elements.

10. The driving method of a liquid crystal display device as set forth in claim 9, wherein:

a Blue (B) picture element is not adjacent to another Blue (B) picture element.

11. The driving method of a liquid crystal display device as set forth in claim 7, wherein:

in the step (a), the display area is divided into picture elements of Red (R), Green (G), Blue (B) and at least one other color.

12. The driving method of a liquid crystal display device as set forth in claim 11, wherein:

in the step (a), the display area is divided into picture elements of Red (R), Green (G), Blue (B), Yellow (Y), Magenta (M) and Cyan (CN).

13. The driving method of a liquid crystal display device as set forth in claim 11, wherein:

in the step (a), the display area is divided into picture elements of Red (R), Green (G), Blue (B), Yellow (Y) and Cyan (CN).

14. The driving method of a liquid crystal display device as set forth in claim 11, wherein:

the display area is divided into picture elements of Red (R), Green (G), Blue (B), Yellow (Y), White (W) and Cyan (CN).

15. The driving method of a liquid crystal display device as set forth in claim 7, wherein:

in the step (a), 1 pixel data of a SVGA module is divided by constant multiple, such as into four pixels of a UXGA module.

16. The driving method of a liquid crystal display device as set forth in claim 7, wherein:

gradation of a current frame and gradation of an immediately preceding frame for a display area are compared with each other and, when a maximum value of a difference between the gradation of the current frame and the gradation of the immediately preceding frame among all liquid crystal elements is at or less than a certain gradation, the gradation of the current frame is outputted without modification.

17. The driving method of a liquid crystal display device as set forth in claim 7, wherein:

gradation of a current frame is added to each of gradations of the gradation variation tables, and resulting values are converted into luminance ratios to figure out display response times so as to create display response time tables, and in a case of coarse resolution, the display response time tables are compared with each other in terms of a longest response time so as to carry out display using a display response time table offering a shortest response time, and in a case of fine resolution, the display response time tables are compared with each other in terms of an average display response time so as to carry out display using a display response time table offering a shortest response time.

18. The driving method of a liquid crystal display device as set forth in claim 17, wherein:

when a pixel contains a Green (G) luminance component in a proportion of 50% or greater, comparison of the longest response time or the average response time is performed only with respect to gradation of Green (G) in selecting a display response time table offering a shortest response time.

* * * * *